US008720134B2

(12) United States Patent
Lindgren et al.

(10) Patent No.: US 8,720,134 B2
(45) Date of Patent: May 13, 2014

(54) METHOD OF INSTALLING A WINDOW ARRANGEMENT COMPRISING A NUMBER OF NEIGHBORING WINDOWS, AND SUCH A WINDOW ARRANGEMENT

(75) Inventors: Claes Lindgren, Farum (DK); Jacob Christian Lund, Vejle Ø (DK); Niels Adelholm Larsen, Frederiksberg (DK); Johnny Christian Nygaard Rasmussen, Hedensted (DK); Jacob Lysemose, Middelfart (DK); Brent Møller, Gentofte (DK)

(73) Assignee: VKR Holding A/S (DK)

( * ) Notice: Subject to any disclaimer, the term of this patent is extended or adjusted under 35 U.S.C. 154(b) by 0 days.

(21) Appl. No.: 13/339,516

(22) Filed: Dec. 29, 2011

(65) Prior Publication Data

US 2012/0167496 A1 Jul. 5, 2012

(30) Foreign Application Priority Data

| | | |
|---|---|---|
| Dec. 29, 2010 | (EP) | 10197235 |
| Jul. 4, 2011 | (DK) | 2011 70359 |
| Oct. 31, 2011 | (DK) | 2011 70590 |

(51) Int. Cl.
*E06B 1/04* (2006.01)

(52) U.S. Cl.
USPC ..... 52/204.1; 52/200; 49/381

(58) Field of Classification Search
USPC ..... 52/200, 204.1, 204.5, 204.57, 204.58; 49/381
See application file for complete search history.

(56) References Cited

U.S. PATENT DOCUMENTS

| | | | | |
|---|---|---|---|---|
| 1,921,303 | A * | 8/1933 | Raschka | 52/200 |
| 5,797,225 | A * | 8/1998 | Ishikawa | 52/93.1 |
| 6,192,643 | B1 * | 2/2001 | Zadok | 52/648.1 |
| 6,629,391 | B1 | 10/2003 | Borresen | |
| 7,331,146 | B1 | 2/2008 | Beutler | |
| 7,392,623 | B2 * | 7/2008 | Back et al. | 52/93.1 |
| 7,836,641 | B2 * | 11/2010 | Back et al. | 52/90.1 |
| 2010/0011682 | A1 * | 1/2010 | Lundsgaard et al. | 52/200 |
| 2010/0018138 | A1 * | 1/2010 | Lundsgaard et al. | 52/200 |
| 2012/0011787 | A1 * | 1/2012 | Lundsgaard et al. | 52/200 |

FOREIGN PATENT DOCUMENTS

| | | | |
|---|---|---|---|
| DE | 3602026 | | 7/1987 |
| DE | 10149058 | | 6/2002 |
| DE | 101 26 395 | C1 | 1/2003 |
| DK | 82857 | C | 5/1957 |
| EP | 0 087 647 | | 9/1983 |
| EP | 0 692 640 | A2 | 1/1996 |
| EP | 1 038 078 | | 9/2000 |
| GB | 461238 | | 2/1937 |
| NL | 1031549 | | 9/2007 |
| WO | WO 88/04348 | | 6/1988 |
| WO | WO 99/27211 | | 6/1999 |
| WO | WO 99/35355 | | 7/1999 |
| WO | WO 00/65171 | | 11/2000 |
| WO | WO 00/65172 | | 11/2000 |
| WO | WO 2009/076952 | A1 | 6/2009 |
| WO | WO2010128341 | | 11/2010 |

* cited by examiner

*Primary Examiner* — Jeanette E Chapman
*Assistant Examiner* — James Buckle, Jr.
(74) *Attorney, Agent, or Firm* — Merek, Blackmon & Voorhees, LLC

(57) ABSTRACT

In the method of installing a window arrangement comprising a number of neighboring windows, a support structure including an upstand is first provided. Each window is provided with a plurality of predefined connection points, and windows are placed next to each other. One window is connected with the other and neighboring window at said predefined connection points.

6 Claims, 41 Drawing Sheets

METHOD OF INSTALLING A WINDOW ARRANGEMENT COMPRISING A NUMBER OF NEIGHBORING WINDOWS, AND SUCH A WINDOW ARRANGEMENT

CROSS-REFERENCE TO RELATED APPLICATIONS

The present application claims the priority under 35 U.S.C. 119 of European Patent Application No. 10197235.4, filed on Dec. 29, 2010; Danish Patent Application No. 2011 70359, filed on Jul. 4, 2011; and Danish Patent Application No. 2011 70590, filed on Oct. 31, 2011, which are hereby incorporated herein by reference in their entireties.

The present application claims the priority under 35 U.S.C. 119 of European Patent Application No. 10197235.4, filed Dec. 29, 2010; Danish Patent Application No. DK 2011 70359, filed Jul. 4, 2011; and Danish Patent Application No. DK 2011 70590, filed Oct. 31, 2011, which are hereby incorporated herein by reference in their entireties.

BACKGROUND OF THE INVENTION

The present invention relates to method of installing a window arrangement comprising a number of windows. The invention furthermore relates to a window arrangement provided by the method.

Window arrangements of this kind may be formed as either an array of juxtaposed windows, the ends of which rest on opposed upstands, most often at different heights, or comprise a number of sets of opposed windows, also called a ridge constellation.

Traditionally, in such window arrangements forming a ridge constellation, two windows meet top-to-top, the tops of the windows resting on a ridge beam extending in parallel with the ridge and with the bottoms resting on opposite wall or facade elements, or in the case of installation on substantially flat roofs, on opposite upstands.

Such window arrangements are installed in many different roof structures under varying conditions. This applies both to the fastening of the window arrangement itself to the subjacent or surrounding roof structure, and to its relation to other window systems or arrangements, which may be installed side-by-side or opposite the window in question.

In most such window arrangements, the top and the bottom of the window are tailor-made for the specific installation conditions, i.a. in correspondence to the nature of the supporting structure. This in turn increases the number of different elements required to form the window arrangement aimed at.

The installation of a single window may be cumbersome in itself. This fact has been elaborated on in the prior art, examples being published international application No. WO 88/04348, in which the window is anchored in the roof structure by means of a number of angular mounting brackets. One leg of these brackets is fastened to the side members of the window frame, and the window is then mounted in the roof opening and fastened by the second leg by screws to the subjacent roof structure, the rafters, the counter-battens or the battens. However, varying measurements have to be carried out in order to ascertain correct positioning, and the measuring is an obvious source of error and can be the reason for considerable delays during mounting, as an erroneous measuring implies that the mounting bracket has to be removed after the window has been mounted in the roof opening.

In published international application No. WO 99/35355, this problem has been addressed and solved in that the mounting bracket is formed as a corner fitting with the first leg portion being formed as two leg sections essentially perpendicular to each other for connection with adjacent frame members at the joint hereof. This document furthermore provides for a solution to the positioning of the window next to and side-by-side other windows. However, even though this installation principle provide for a substantially increased ease of installation relative to the then prior art, the mounting bracket disclosed in this document has a limited degree of flexibility with regards to its field of use.

An item of prior art concerned with the increase of flexibility is published international application No. WO 00/65171, in which a multi-purpose fitting for connection of a frame structure of a panel with a support element is described. This document describes a progress over the then prior art, in which particularly designed fittings for fixed panels are usually designed as support fittings with oblique sections defining the possible inclination of the panel. In openable panels, the connection is made by especially designed hinge fittings, and solves the problem that fittings of this kind used in panels for construction of e.g. tilted surfaces must be produced in several various forms because of the structure of the known fittings, dependent on whether the panel is to be openable or fixed and on the inclination of the panel. By the multi-purpose fitting of this document, the angle of inclination of the panels is adjusted by means of a separate mounting and hinge fitting, the support element can be produced as a standard product, and the adjustment of the fitting according to the desired inclination can be effected at any time, e.g. on the building site where the final mounting takes place. As the fittings further serve as hinge fittings of the openable panels, an additional standardization is obtained, as all panels can then be prepared for opening and only at a relatively late stage during the project is it necessary to decide whether the individual panel is to be openable or fixed.

Opening and closing of the sash structure relative to the frame structure in such window systems normally takes place by means of a suitable operator. In traditional roof windows and other roof penetrating structures mounted in a roof, such as hatches and panel systems, one type of operator is the chain operator, another type being the scissors operator. Examples of such arrangements are described in for instance DE 101 26 395 C1 and WO 2009/076952. As it is desired to make the operator as inconspicuous as possible, the operator itself or its housing is embedded in the frame structure, typically the bottom frame member.

However, this solution requires that the space needed to accommodate the operator in the frame member may be provided in the frame member. In some windows, this is either not an option due to the geometrical restrictions of the window parts or it is not for some reason desired to make room for the operator in the frame structure. One way of operating such windows is by mounting a pressure medium operated cylinder at the bottom frame member, and connecting the free end of the piston to the bottom sash member, one example of prior art disclosing such an arrangement being EP 0 692 640 A1.

Increasing architectural demands have rendered it desirable to provide windows or panels to be positioned side-by-side or opposite each other with a uniform appearance. One document concerned with the uniform appearance of such panels is published international application No. WO 00/65172, in which openable and fixed panels are provided with a similar appearance. However, in this document there is no frame structure and no solution as to how the inconspicuous opening and closing of the panels relative to the fixed structure is provided.

The weight of such a window system may be substantial. This depends partly on the materials chosen, partly on the dimensions of the window system. Most of the weight is concentrated to the sash structure due to the pane. In particular in large windows, in which the area of the pane is very large relative to the sash and frame structures, this poses particular demands to parts to the design of the sash and frame structures. This effect has increased as a result of the demands to insulating properties, meaning that there are often two or even three sheets of glass or other glazing material in one pane.

In the prior art, measures have been taken to increase the rigidity of the sash and frame members, one example being published international application No. WO 00/65172. In this publication an element accommodated in the frame member and extending over essentially the entire length thereof makes it possible to vary the moment of inertia of the frame member and thereby optimize the configuration of the panel system. However, this solution is not immediately applicable to all kinds of panel systems, in particular not those comprising both a frame and a sash, and in which particular care must be taken when transmitting the load from the sash via the frame and further to the supporting underlying roof structure.

Furthermore, securing the window and the window system against the weathering is a crucial issue. An arrangement of coverings and flashings must therefore be provided. In prior art flashings, the flashing comprises one or more flashing members each having a first leg intended for being placed against an external surface of the window frame and a second leg being arranged at an angle with respect to first leg so that it projects from the window frame. The second leg has opposite first and second edges, said first edge being connected to the first leg, and two end edges interconnecting the first and second edges.

Roof window flashings are typically composed of a set of flashing members or flashing frames, which are attached to the window frame one by one in an overlapping manner so as to make the joint between the window and the roof watertight. Examples of such flashings are found i.a. in DK82857C, EP0087647A1 and EP1038078B1.

It is noted that in this the designation "flashing member" is used in its traditional meaning, namely a member arranged to engage both the roof and the window frame, whereas, for the sake of simplicity, the general term "flashing" is used for the entire set of members used for waterproofing the joint between the window and the roof, including cladding and covering members.

Traditionally, the flashing members are attached to the window frame by means of screws. This works very well with windows having wooden or plastic frames, where the screws may enter and come into a stable engagement with the frame virtually at any point.

During in particular the production processes, it is desirable to maintain a standard platform accommodating the various end uses to the extent possible. Thus, it is a wish to provide a window which is as standardized as possible, but in which the supply and installation conditions are still as flexible and uncomplicated as possible.

SUMMARY OF THE INVENTION

With this background it is an object of the present invention to provide a method of window arrangement of the kind stated in the introduction, in which an increased standardization and modulation of the production is feasible, and the installation at the building site is facilitated.

In one aspect of the invention, this is obtained by a method of installing a window arrangement comprising a number of neighbouring windows, comprising the steps of i) providing a support structure including an upstand, ii) providing one window with a plurality of predefined connection points, iii) providing another window with a plurality of predefined connection points corresponding to the predefined connection points of said one window, iv) placing said other window next to said one window, v) connecting said one window with said other window at said predefined connection points.

Other aspects of the invention provide for a method of providing a window arrangement comprising a set of gable elements and a number of sets of opposed windows. In a first such other aspect of the invention, this is achieved in that the method of providing a window arrangement comprising a set of gable elements and a number of sets of opposed windows, comprises the steps of:

a) providing a support structure, b) providing a first gable element of a set of gable elements, c) mounting the first gable element on the support structure, d) providing a second gable element of said set, e) connecting the second gable element temporarily and releasably to the support structure at a distance from the first gable element corresponding substantially to the width of a window, f) providing a first window of a first set of opposed windows, g) connecting the first window with the first and second gable elements and with the support structure, h) providing a second window of the first set of opposed windows, i) connecting the second window with the first window and with the support structure, j) releasing the second gable element from the first window and from the support structure, k) connecting the second gable element temporarily and releasably to the support structure at a distance from the first set of opposed windows corresponding substantially to the width of a window, whereby steps f) to k) are repeated a number of times corresponding to the predefined number of sets of opposed windows, except for step k) wherein the second gable element is connect permanently to the windows of the last set, the method further comprising the step of:

l) connecting the windows of neighbouring sets of opposed window to each other in said connection points, m) connecting the windows of the first set of opposed windows to the first gable element in said connection points and connecting the windows of the last set of opposed windows to the second gable element in said connection points.

In this manner, it is possible to provide a window arrangement forming a ridge constellation by the use of only two gable elements, thus making a ridge beam superfluous. The opposed windows of one set or pair are self-supporting once both windows of the pair have been installed.

In a further other aspect of the invention, a window arrangement is provided. The window arrangement comprises a number of sets or pairs of opposed windows which are self-supporting. The gable elements thus only form part of the supporting structure during installation. Once all windows have been installed, the gable elements are left to form each end of the window arrangement and may as such form the basis for finishing details.

An auxiliary rafter or mounting beam may, however, also be used for the temporary support of the windows during installation in stead of the second gable element.

In yet another aspect of the invention, a window of such a window arrangement is provided. According to the invention, the window comprises a substantially rectangular frame structure having four corner sections and a bracket arrangement comprising a set of bracket units, each bracket unit including a base element mounted at each corner section of the frame structure, each bracket unit furthermore comprising at least one supplemental element adapted to be detachably connected to said base element.

The actual connection of neighbouring windows at the connection points may be achieved by means of a set of connection brackets, each set of connection brackets preferably including a pair of first parts, which are attached one to each of the neighbouring frame side members, and a second part, which are connected to each of the first parts of said pair. For the ease of installation, the set of brackets is preferably made so that the second part is to be attached to the first parts from the exterior side of the window arrangement.

For providing a waterproofing, the method may comprise the further step of providing cover elements and flashing elements. Attachment of the covering elements may be achieved by providing each side frame member not facing the side frame member of a neighbouring window with a plurality of covering brackets. These covering brackets are preferably located at said predefined connection points and may be applied on top of a preinstalled first part of a set of connection brackets.

Further embodiments and advantages are set forth in the dependent claims.

BRIEF DESCRIPTION OF THE DRAWINGS

In the following the invention will be described in further detail by means of examples of embodiments with reference to the schematic drawings, in which.

DETAILED DESCRIPTION OF THE PREFERRED EMBODIMENTS

Figure 1:
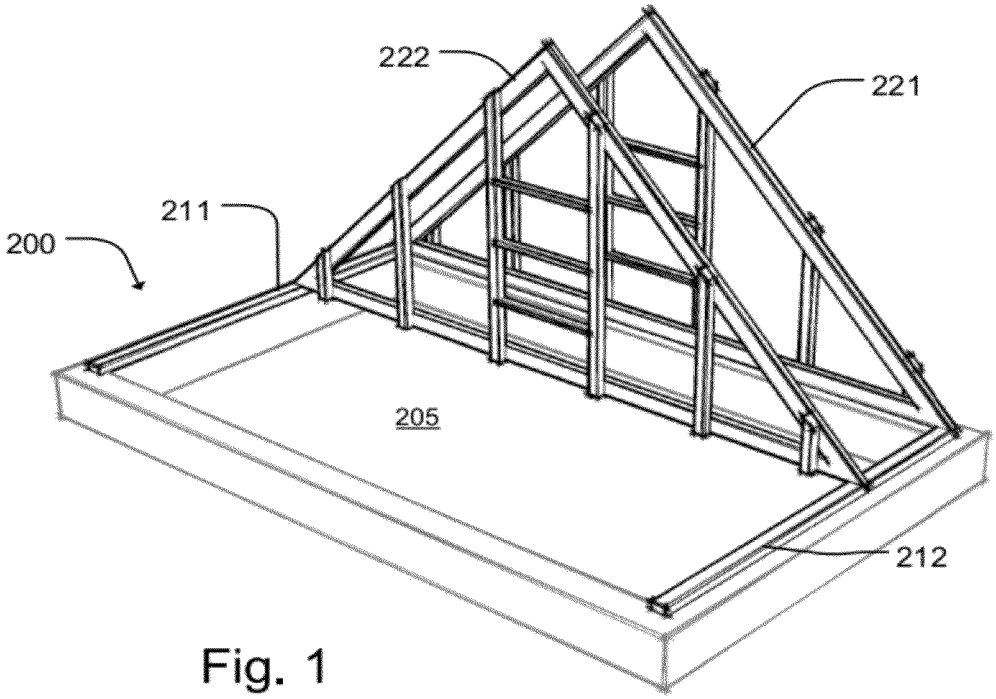
FIGS. 1 to 5 show perspective views of a first embodiment of a window arrangement according to the invention during steps of an embodiment of a method of providing the window system according to the invention.

The inventive method of providing a window arrangement will be described with particular reference to FIGS. 1 to 5.

The window arrangement may be installed on any suitable supporting structure, including walls and other facade elements, and is in the embodiment shown in the drawings an upstand generally designated 200 and built into a substantially flat roof structure (not shown).

The upstand 200 may for instance be formed as a concrete element cast either as a coherent element or assembled by a number of parts to form two longitudinal portions extending in parallel with the direction of the ridge of the window arrangement, and two transverse portions, together framing an opening or clearing 205. On top of each of the longitudinal portions, a beam element 211, 212 is placed. The beam elements 211 and 212 may be formed in any suitable manner, for instance by dimensional lumber 2×4 of softwood, or be a beam of metal or other suitable material, such as for instance an I-beam to be described in further detail in another embodiment.

In a first step of the inventive method, a set of gable elements 221 and 222 is provided. The gable elements 221 and 222 may be formed as identical parts made up of dimensional wood and define the slope or pitch of the window arrangement. The dimensions of each gable element 221, 222 are such that the length corresponds in substance to the length of the transverse portions of the upstand 200 and bridges the distance between the beam elements 211 and 212.

Each gable element 221, 222 may be provided by abutment means, not shown in detail, protruding from the underside of the gable element into the clearing defined by the opposed beam elements and/or the longitudinal portions of the upstand 200 in order to prevent movement of the gable element in the transverse direction. The height is determined by the desired pitch of window arrangement. In the embodiment shown, the pitch is approximately 45° but the pitch may vary.

Subsequently, the one gable element 221 is fastened to the supporting structure, in the embodiment shown thus to the one transverse portion of the upstand 200 and to the beam elements 211 and 212, for instance by screwing the longitudinal ends of the gable element 221 into the beam elements 211 and 212. The other gable element 222 is connected to the beam elements 211 and 212 as well and possibly also to the opposed longitudinal portions of the upstand 200, at a distance from the one gable element 221 corresponding in substance to the width of a window to be used in the window arrangement.

On the condition that two opposed windows have the same width, the windows of the window arrangement need not necessarily all be of the same character or have the same width; for instance one or more windows may be formed as a panel element having a different character.

In the preferred embodiment however, all windows 231, 232; 233, 234; and 235, 236 of the window arrangement have a similar structure to be described in detail below. The connection between the other gable element 222 and the beam elements 211, 212 and possibly the longitudinal portions of the upstand 200 is releasable, meaning that the connection may be disengaged without substantial damage to either of the elements involved. The position shown in FIG. 1 has now been attained.

Following the erection of the two gable elements 221, 222, a first window 231 of a first pair is mounted to the one side of the juxtaposed gable elements 221, 222. This is carried out by connecting fittings present at the top of the window 231 to the gable elements 221, 222, for instance by brackets (not shown) connected to the apex of each gable element. Embodiments of the fittings at the top of the window will be described in more detail below. The window 231 is lifted into place either manually or by means of crane. Subsequently, the window 231 is swung down about the fittings at the top such that the bottom thereof may be connected to the beam element 211. Details of this operation are to be described further on. A second window 232 of the first pair is then lifted into position and the top of the second window 232 is positioned opposite the top of the first window 231. The fittings of the second window 232 are connected to those of the first window 231 and the position shown in FIG. 2 has been attained.

The second window 232 is swung into position and the bottom of this window is fastened to the beam element 212. As the tops of the first and second window 231 and 232 of the first pair of windows of the window arrangement now rest against each other by the connection between the respective fittings, the gable elements 221 and 222 are in principle superfluous for structural reasons, as the windows of the arrangement are self-supporting.

The one gable element 221 remains connected to the first window 231 by its connection to the bracket at the apex of the gable element 221, but the other gable element 222 is released from its engagement with the first window 231 and from the beam elements 211, 212 and possibly the longitudinal portions of the upstand 200. The other gable element 222 is subsequently moved to position spaced apart from the sides of the windows 231, 232 of the first pair opposite the one gable element 221. Here, it is re-connected releasably to the beam elements 211 and 212 and possibly the opposite longitudinal portions in the manner described in the above. Subsequently, the first window 233 of a second pair of windows of the window arrangement is at its top connected to the fitting of the first window 231 and to the bracket at the apex of the other gable element 222 to attain the position shown in FIG. 3.

Figure 4:
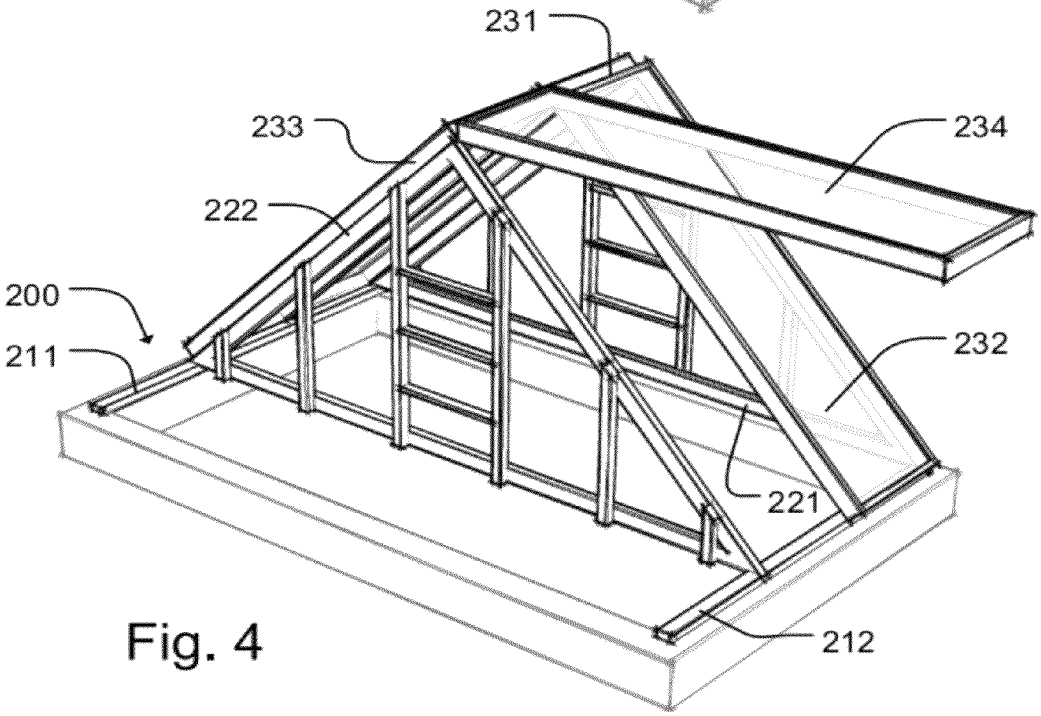

Following fastening of the bottom of the first window 233 of the second pair to the beam element 211 and possibly the longitudinal portion of the upstand 200, a second window 234 of the second pair is connected to the first window 233 by its fittings at the top to attain the position of FIG. 4. Subsequent to the position shown in FIG. 4, also the bottom of the second window 234 is secured to the beam element 212 on the upstand 200.

Figure 5:
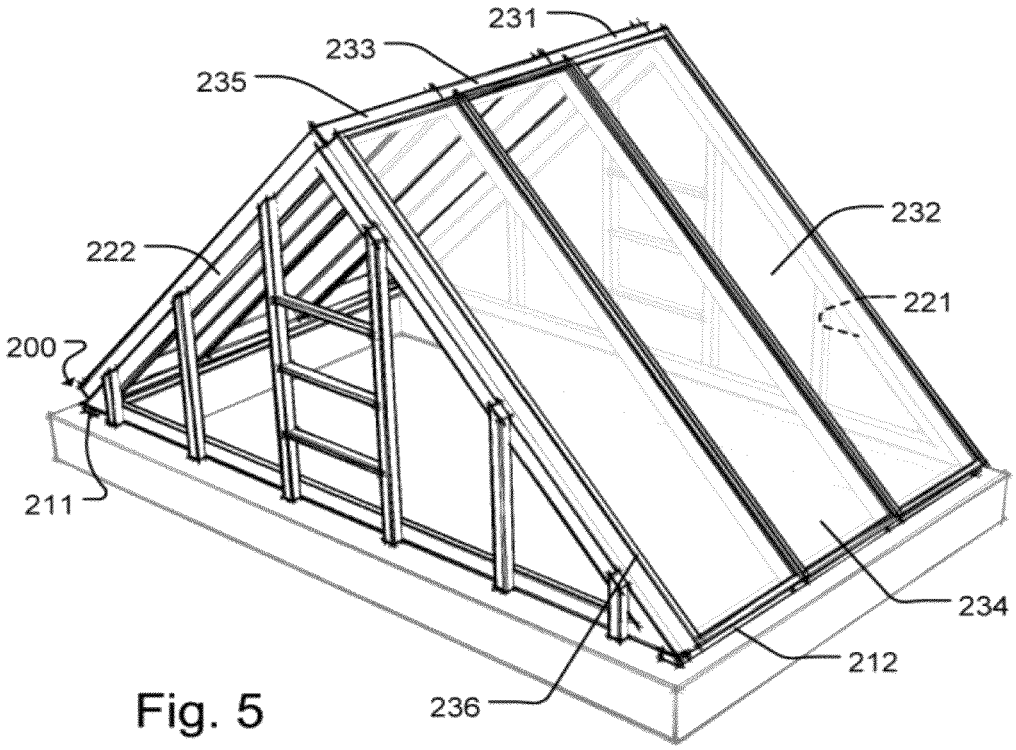

The steps of removing the other gable element 222 from its engagement with the first window and from the beam element 211 is repeated, as is the step of positioning the other gable element 222 at a distance from the sides of the first and second window of the preceding pair of windows of the window arrangement. In FIG. 5, the other gable element 222 has been positioned at the transverse portion 204 opposite the transverse portion at which the one gable element 221 is positioned. At this point, the other gable element 222 is fastened permanently to the beam elements 211 and 212 and possibly the other transverse portion of the upstand 200.

Figure 2:
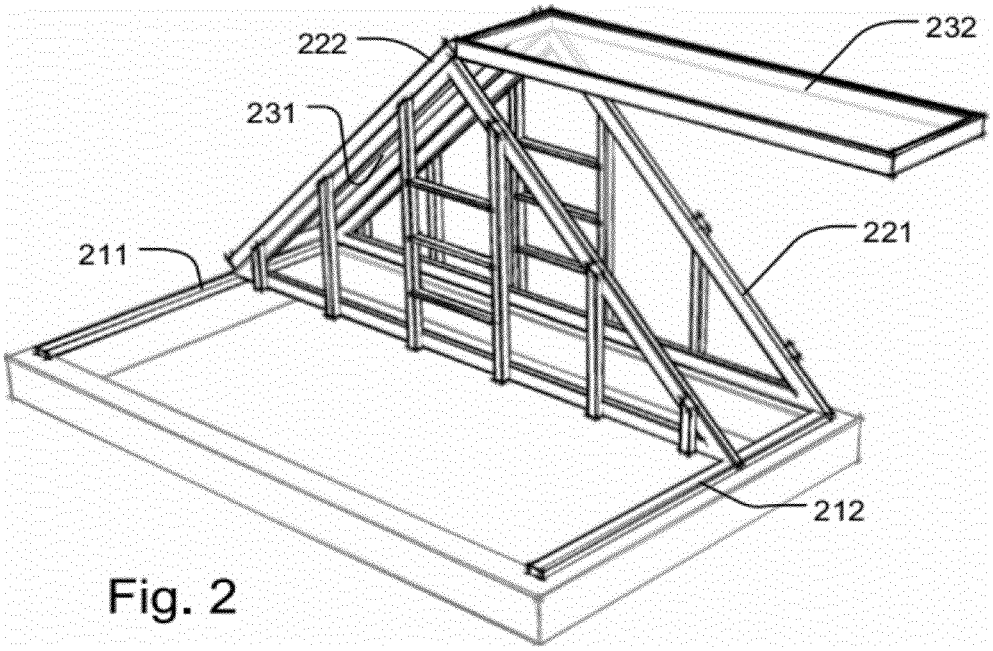
Figure 3:
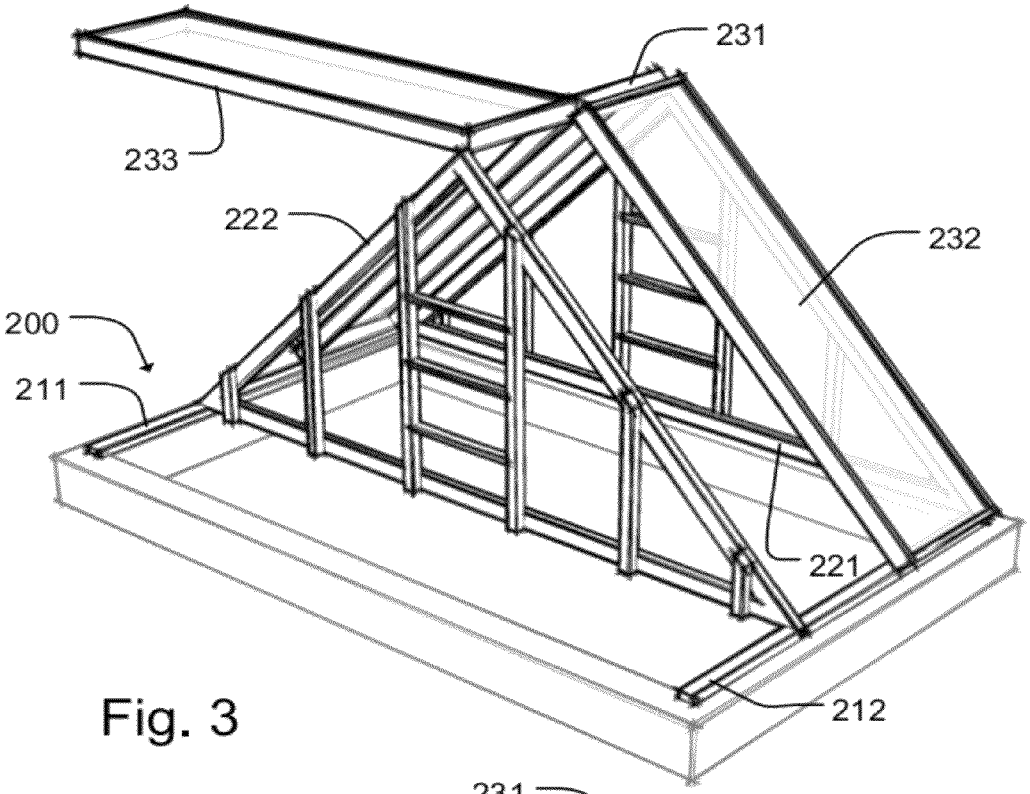

The permanent connection may be the same as the temporary connection shown in the position of FIGS. 1 and 2, or comprise further fastening means according to needs or specifications. In FIG. 5, it is shown how the first window 235 of the third and last pair of windows of the window arrangement has already been connected to the first window 233 of the preceding pair, i.e. the second pair, and to the other gable element 222. Furthermore, the second window 236 is shown in the situation, in which the top of the second window 236 is connected to the top of the first window 235 and by its bottom to the beam element 212.

Following fastening of the second window 236 of the last pair of windows of the window arrangement to the beam element 212, the principle underlying the window arrangement according to the invention is illustrated. Thus, the window arrangement contains a number of pair of self-supporting windows.

However, finish is normally provided, in the form endings at the respective gable elements 211 and 212, just as flashings and coverings are provided. Details relating to such aspects will be described below.

In the several views of the drawings, embodiments of a window of a window arrangement according to the invention are shown. The window comprises a substantially rectangular frame structure generally designated 1; apart from this feature, the design of the window is arbitrary and may for instance take the form of a panel system comprising a frame and sash combination, in which the sash carries a pane and may be opened for ventilation or smoke evacuation purposes, or fixed, that is, not openable relative to the frame structure. Other conceivable designs include a non-transparent or partially transparent panel element such as a solar panel.

Whenever a reference number is used, this is to be understood as an indication that reference is made to the particular feature in general and that there is no substantial difference between the two windows.

The window according to the invention may be used for many different geometrical configurations, e.g. as structural skylights abutting upstands such as an array of long lights forming a light band and ridge constellations. In the following, both embodiments relating to the use in a window arrangement as described in the above with reference to FIGS. 1 and 5, and elements to take part in other configurations will be described.

Referring first to the general description of a frame structure 1 of the window according to an embodiment of the invention as shown in FIGS. 8 to 12, the frame structure 1 has four corner sections 1*a*, 1*b*, is and 1*d* and is adapted to be installed in a roof structure (not shown). In the embodiment shown, the frame structure 1 is composed by four frame members 2, 3, 4 and 5, extending between respective corner sections; however, the frame structure may also be a coherent structure. The window furthermore comprises a bracket arrangement comprising a set of bracket units 6*a*, 6*b*, 6*c* and 6*d*. According to the main principle underlying this aspect of the present invention, each bracket unit includes a base element 10*a*, 10*b*, 10*c* and 10*d* mounted at the respective corner section 1*a*, 1*b*, 1*c* and 1*d* of the frame structure 1.

Additionally, each bracket unit comprises at least one supplemental element adapted to be detachably connected to the base element. The individual configuration of each bracket unit of the embodiment shown will be described in detail further down. In this description, terms such as "lower", "upper", "left-hand", "right-hand", "side", "top", "bottom", etc. refer to the shown position of the window only, and is not to be interpreted as limiting the window to use in a particular position.

Figure 6:
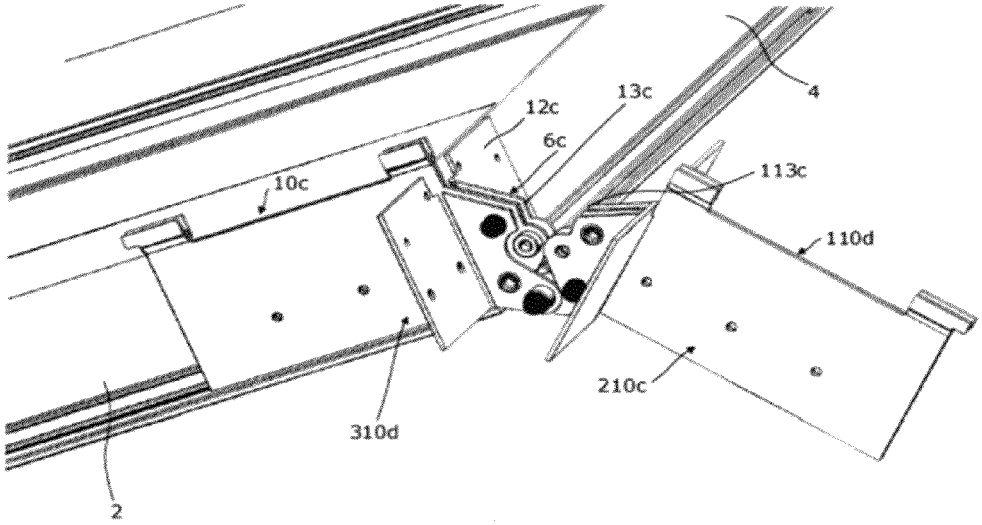
FIG. 6 is a perspective view of a detail of a second embodiment of the window arrangement according to the invention.

Referring in particular to FIG. 6, a particular use of the window according to the invention is shown, viz. in a window arrangement, for instance to be provided by means of the inventive method. In FIG. 6, only one window is shown; this window corresponds to the first window 231 of the first set of opposed windows of the embodiment shown in FIGS. 1 to 5. The other windows are omitted for reasons of clarity, and would correspond to the second window 232 of the first pair and to the first and second windows 233 and 234 of the second pair. As shown, the bracket unit 6*c* is shown in a basic condition, i.e. comprising only base element 10*c* including its engagement means 13*c*.

The engagement means 13*c* are adapted to be connected to the engagement means 113*c* of a supplemental element constituted by the base element 110*d* of another, second window positioned opposite to the window shown, to the base element 310*d* of a third window next to the first window, and to the base element 210*c* of a fourth window opposite the third and next to the second, thus making interconnection of four windows possible. In the embodiment shown, the respective engagement means are complementary to each other.

Figure 7:
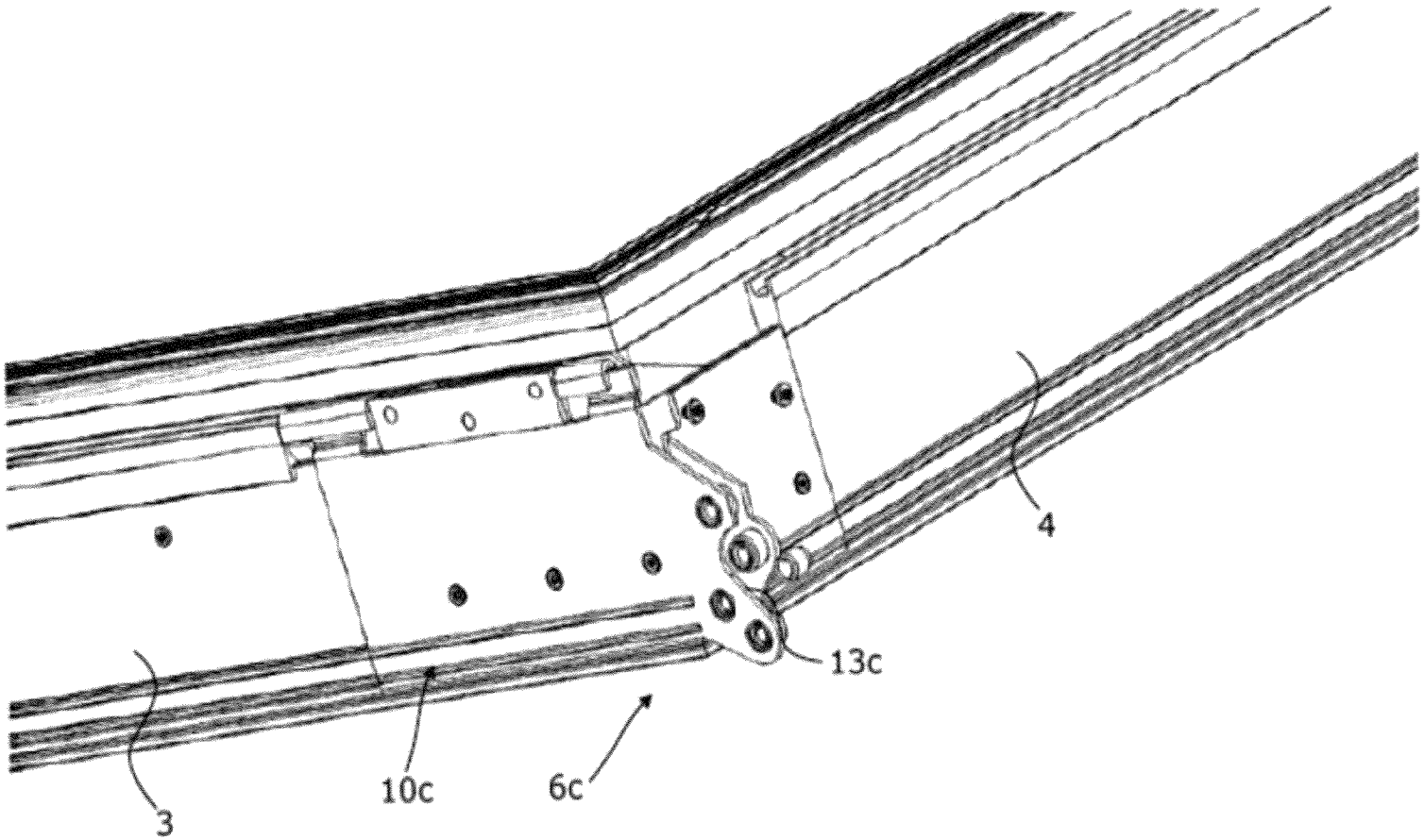
FIG. 7 shows a detail of an embodiment of a window of the third aspect of the invention.
Figure 8:
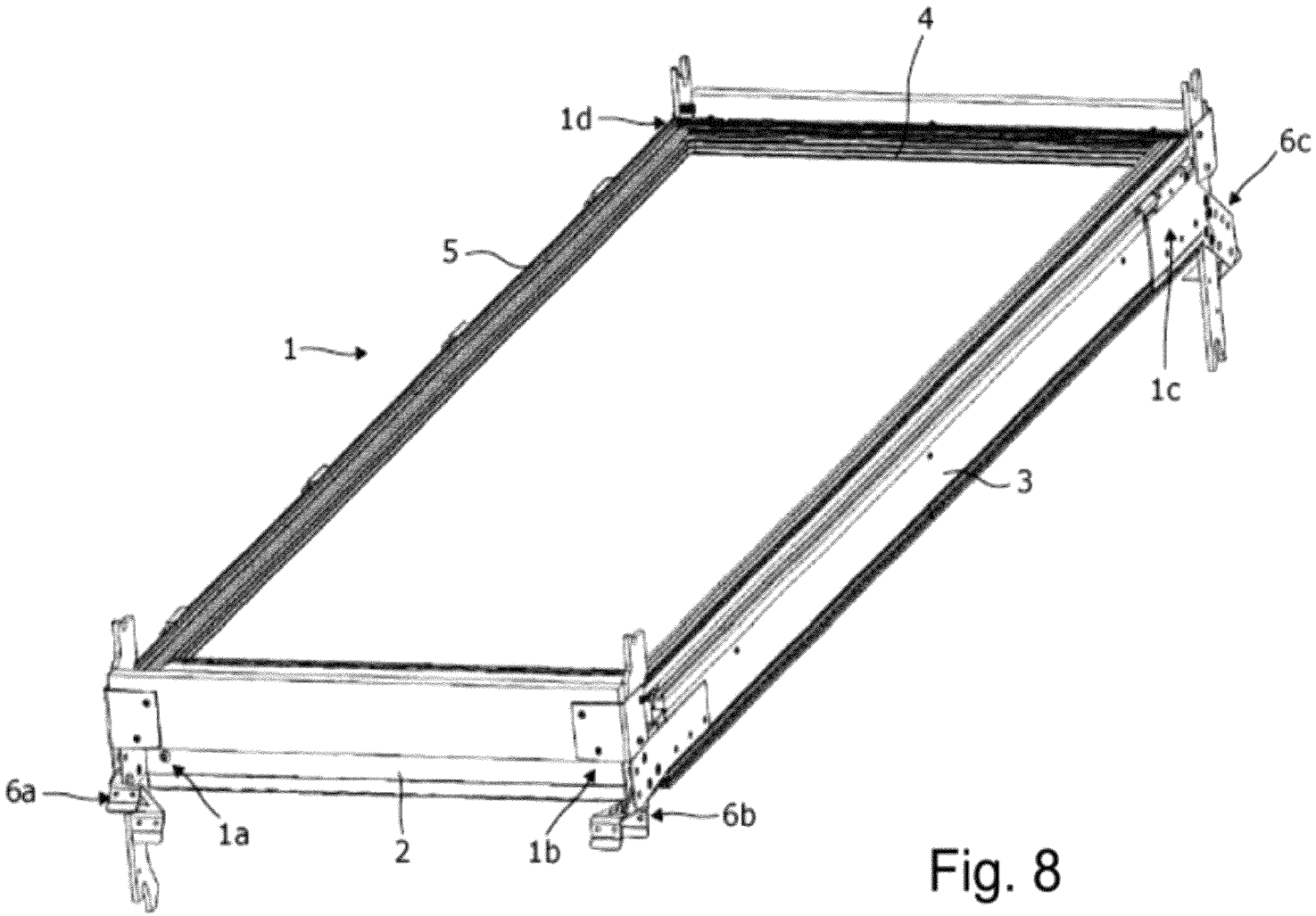
FIG. 8 is a perspective view of a window in an embodiment of the invention.

In principle, each base element could be formed as illustrated in FIG. 7, and combined with an arbitrary panel element, which needs not necessarily be a window, but could in principle be any panel element, such as a blind panel, a solar panel etc. The base element would then be combined with suitable supplemental element(s).

Referring now in particular to FIGS. 8 to 12, one such supplemental element comprises, in the embodiment shown, a leg element 20*a*, 20*b*, 20*c* which in the shown state is connected to the respective base element 10*a*, 10*b*, 10*c* in a manner which is rotatable and detachable, that is the leg element may be connected and disconnected from the base element by suitable connection means and is able to rotate about an axis of rotation relative to the base element.

In the bracket unit 6*a* positioned in the corner section 1*a* in the lower left-hand corner of the frame structure, at the intersection between the bottom frame member 2 and one side member 5, the base element 10*a* is formed by two substantially plate-shaped parts 11*a*, 12*a* such that they together surround the intersection in the corner section 1*a* and protrude from the frame structure in a plane substantially parallel to that of the frame side member 5. The base element 10*a* could also be formed as a one-part element. At a distance from the bottom frame member 2, the leg element 20*a* is connected to the base element 10*a* in a hinge connection including a bolt 21*a* and matching apertures (not shown) in the base element 10*a* and hinge portion 22*a* of the leg element 20*a*. The leg element 20*a* furthermore includes fastening means for connection to the roof structure. In the embodiment shown, the fastening means include two portions 24*a* and 25*a* formed as folded portions depending from abutment portion 23*a* and a plurality of apertures in the folded depending portions. This embodiment is particularly useful in installation conditions involving a beam, for instance positioned on an upstand made to that purpose in a roof.

Figure 9:
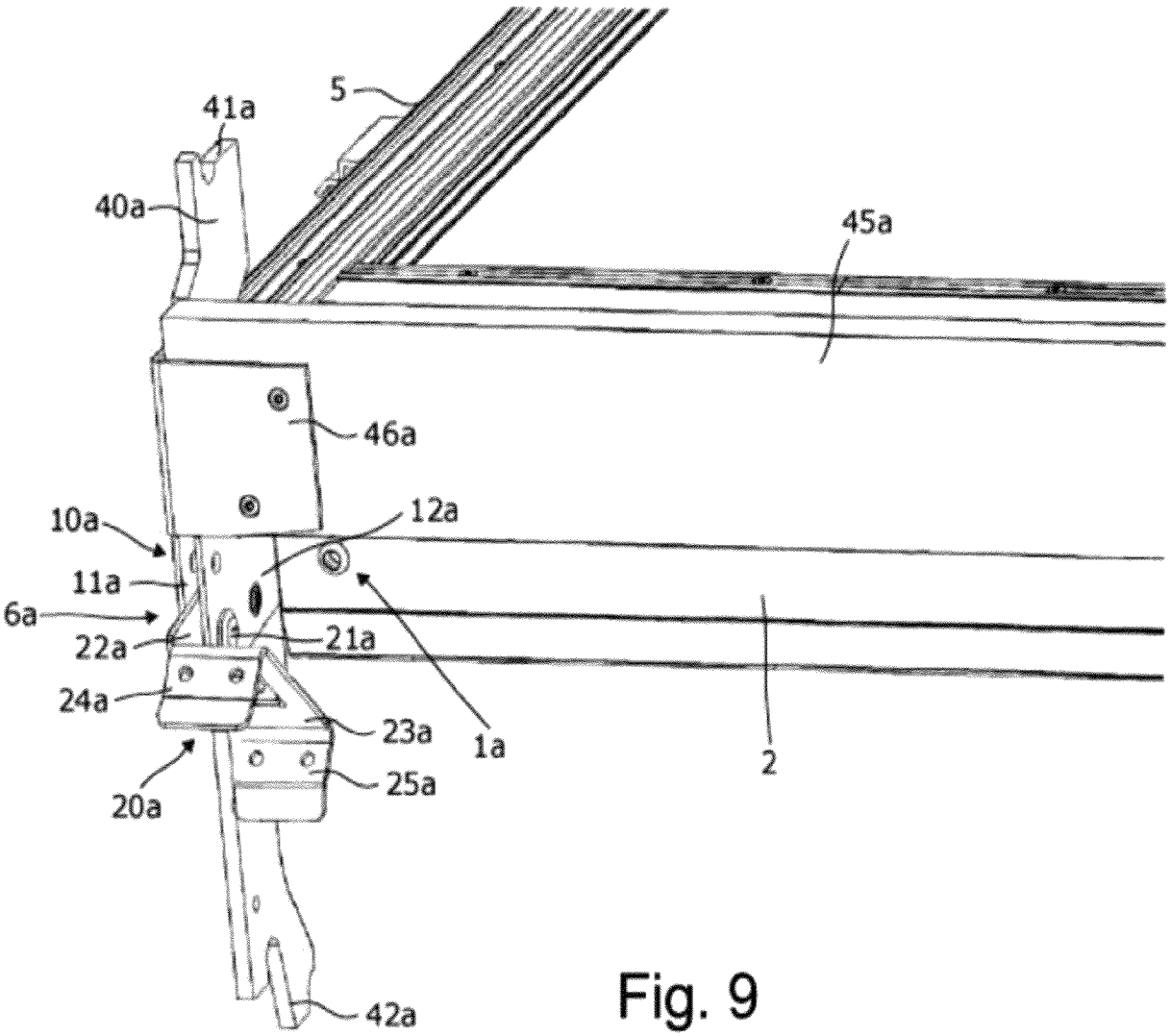
FIG. 9 is a partial perspective view, on a larger scale of the lower left-hand corner part of the window shown in FIG. 8.
Figure 10:
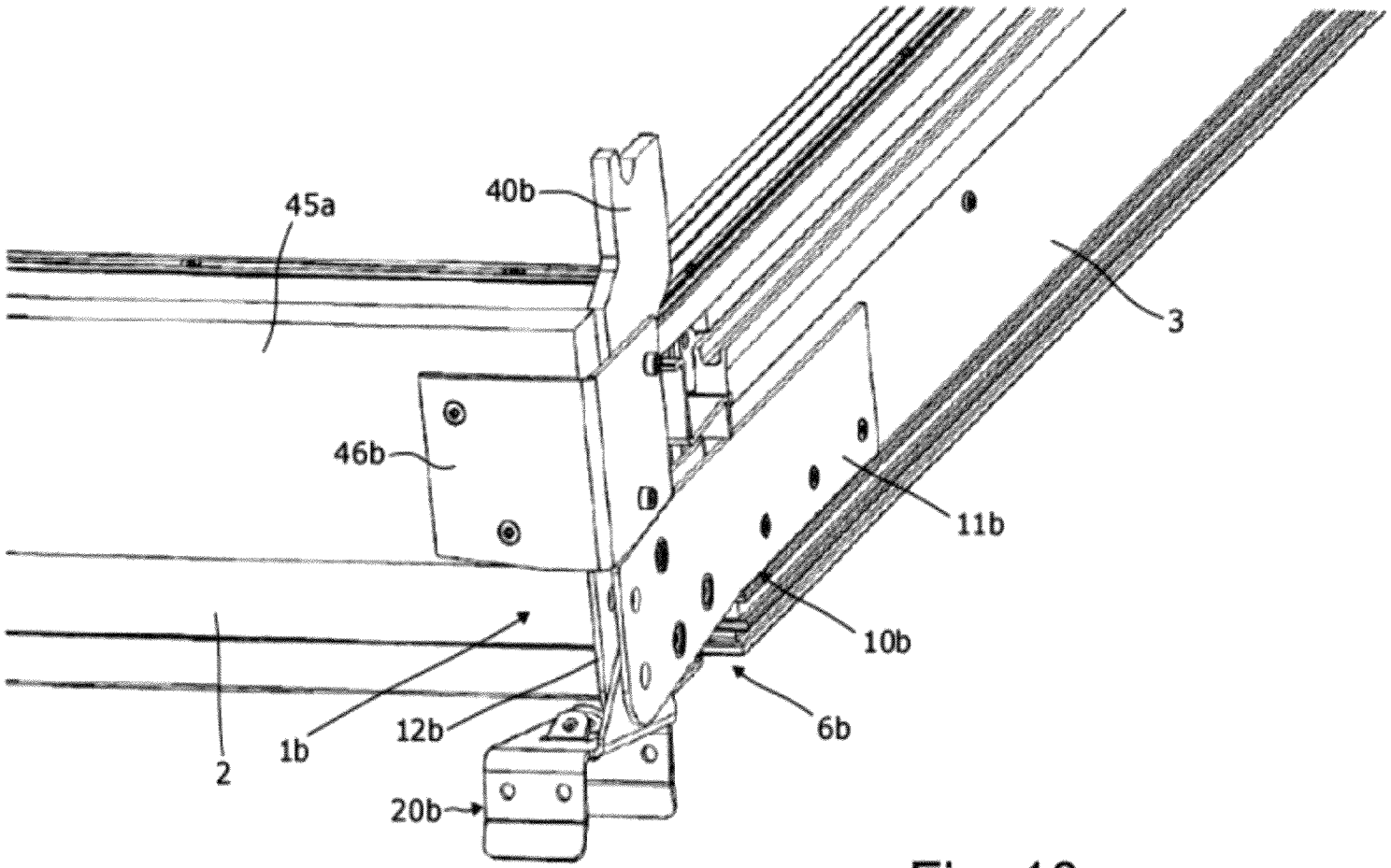
FIG. 10 is a partial perspective view, on a larger scale of the lower right-hand corner part of the window shown in FIG. 8.

As shown in FIG. 10, the base element 10*b* and the leg element 20*b* of the bracket unit 6*b* of the lower right-hand corner are configured in manner corresponding to that of bracket unit 6*a*. In FIGS. 9 and 10, the window is shown in a state of storage, in which the window is adapted to be positioned in a stack of similar windows, for instance up to six windows. To that end, a supplemental element comprising a spacer element 40*a* and 40*b*, respectively, is connected to the respective base element 10*a* and 10*b* in a detachable manner, for instance by bolts (not described in detail). The spacer elements 40*a*, 40*b*—together with corresponding spacer elements at the top of the window—provide for the space needed between windows positioned on top of each other and protect the windows by transmitting the weight of the upper window or systems to the lower window or systems via the base elements of the bracket units, without parts of the frame structure or other parts of the window coming into contact with each other. Each spacer element has an upper end and a lower end, the upper end 41*a* and the lower end 42*a* of the spacer element 40*a* of the lower left-hand corner section 1*a* being provided with engagement means, the respective engagement means at the upper end and the lower end being complementary to each other. The spacer element 40*b* at the lower right-hand corner section 1*b* may have a similar configuration, or as shown, a lower end ending at the base element 10*b*. The spacer elements 40*a* and 40*b* are connected to each other by means of a transverse bar member 45*a* by means of suitable fittings 46*a*, 46*b*.

Figure 11:
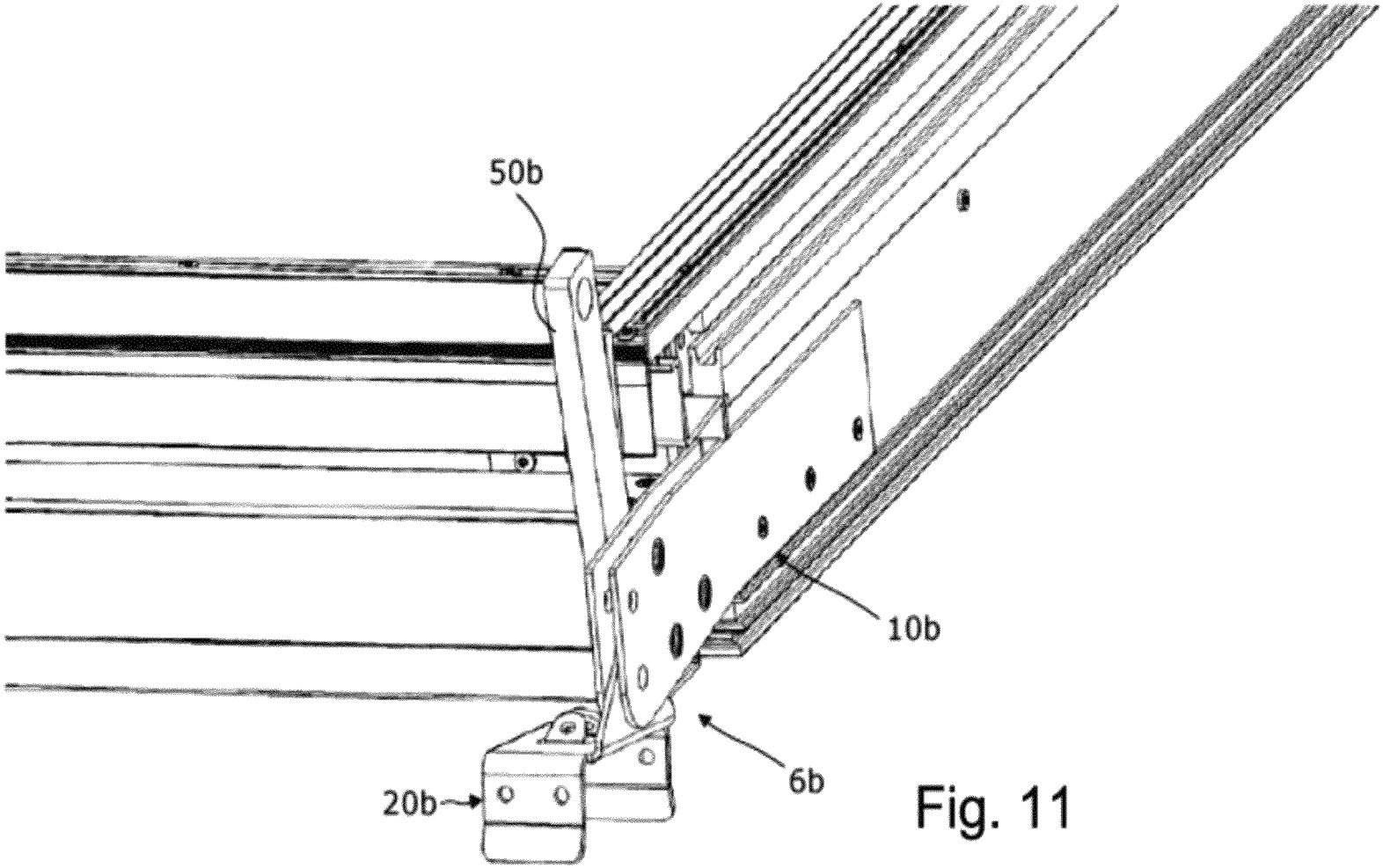
FIG. 11 is a view corresponding to FIG. 10, in another state with some parts of the window in the embodiment shown removed.
Figure 12:
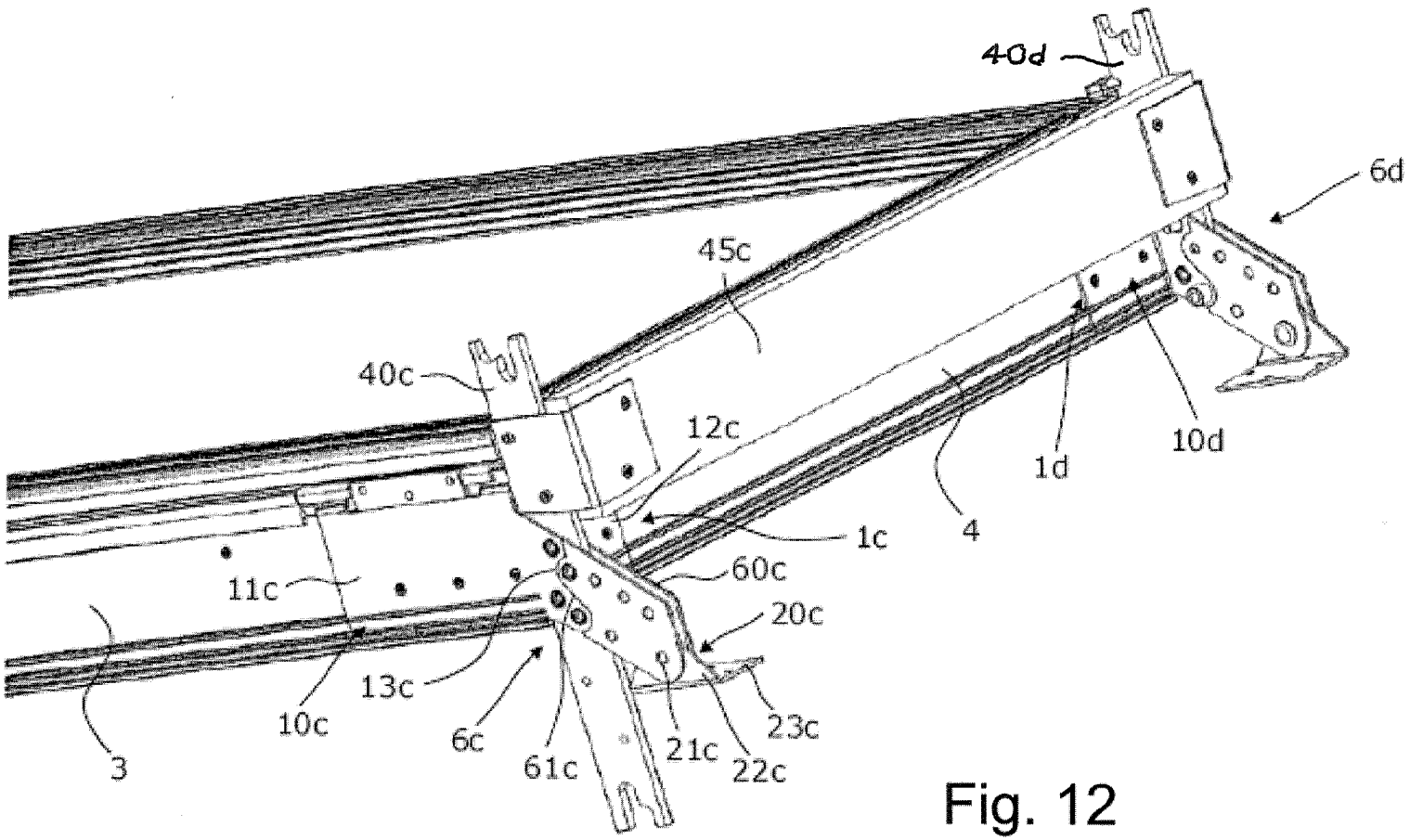
FIG. 12 is a partial perspective view, on a larger scale of the top part of the window system shown in FIG. 8.

In FIG. 11, showing the lower right-hand corner of the window, the window is shown in a state of delivery, in which the spacer elements 40*a* and 40*b* have be detached from the respective base element 10*a* and 10*b*. Another supplemental element connected detachably to the base element 10*b* is shown in this Figure, namely a lifting element 50*b*. Together with corresponding lifting elements in the other corner sections of the window, this makes it possible to lift the entire window by means of suitable hoisting means, from the place of delivery, typically on the ground at the building site, or directly from a delivery lorry, up to the roof.

In principle, all base elements of the window could be formed in an identical manner, and be provided with one or more supplemental elements to adapt the bracket unit to its specific purpose. However, in the embodiment shown, the bracket units 6*a*, 6*b* at the bottom part of the window are substantially identical, and the bracket units 6*c*, 6*d* at the top correspond to each other but slightly are different from bracket units 6*a*, 6*b* at the bottom part. Referring now to FIGS. 12-14 and 6-7, the top part of an embodiment of the window will be described in detail.

In the embodiment shown in these Figures, the bracket units 6*c* and 6*d* correspond to each other and only the bracket unit 6*c* will be described in detail. The base element 10*c* comprises two plate-shaped parts 11*c*, 12*c* and is connected to a leg element 20*c*. However, as opposed to the bracket units 6*a*, 6*b* at the bottom part of the window the leg element 20*c* is connected to the base element 10*c* by means of an adaptor element 60*c*. The adaptor element 60*c* is provided with engagement means 61*c* complementary to engagement means 13*c* of the base element 10*c*. Additional fastening may be provided, for instance in the form of detachable bolts. The leg element 20*c* is provided with a hinge portion 22*c* hingedly and detachably connected to the adaptor element 60*c* by a bolt and is provided with fastening means in the form of abutment portion 23*c* and a number of suitable apertures.

As at the bottom part of the window, the bracket units 6*c*, 6*d* at the top are provided with spacer elements 40*c*, 40*d* at each end of transverse bar 45*c*.

Figure 13:
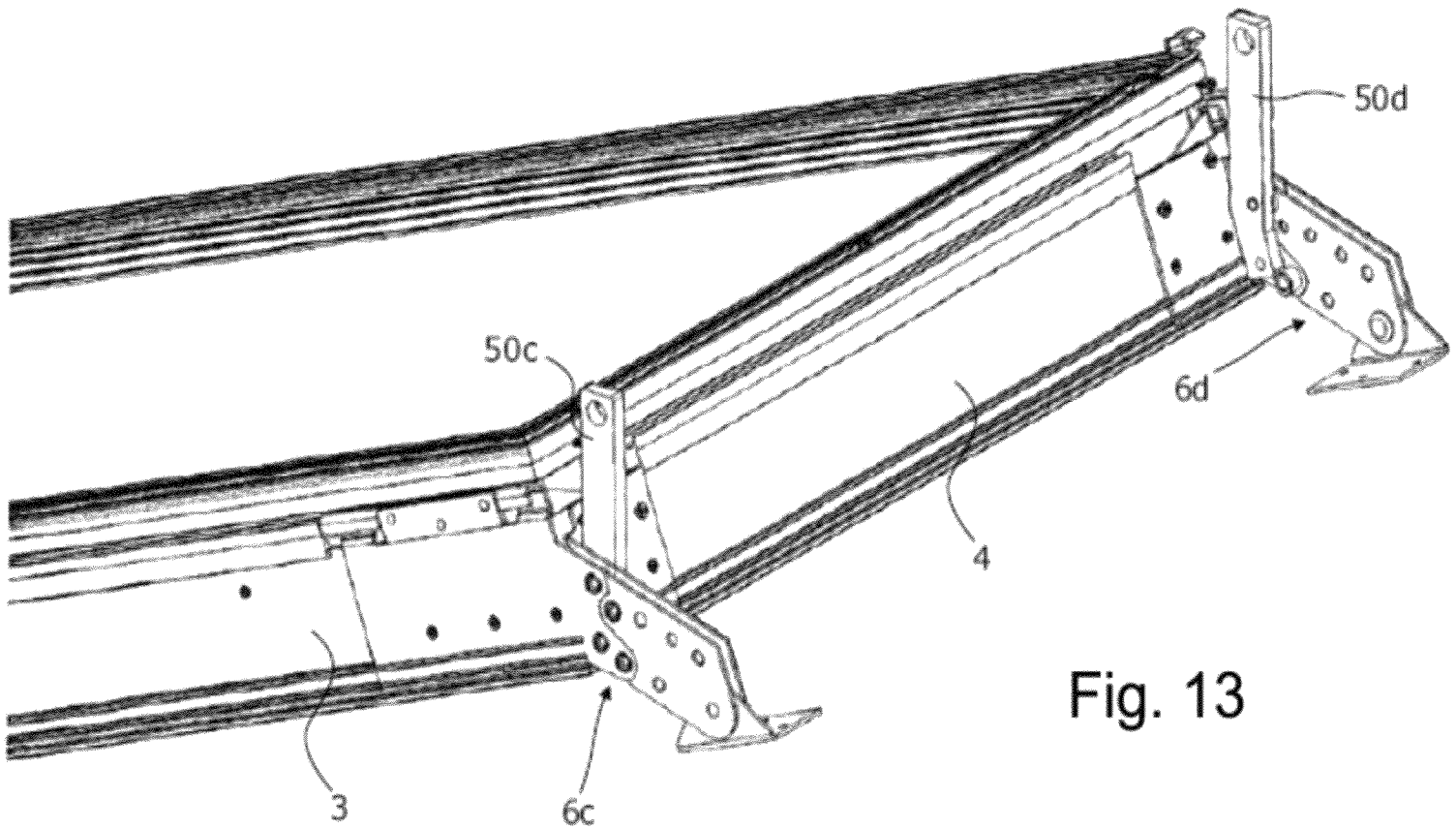
FIG. 13 is a view corresponding to FIG. 12, from a different angle.
Figure 14:
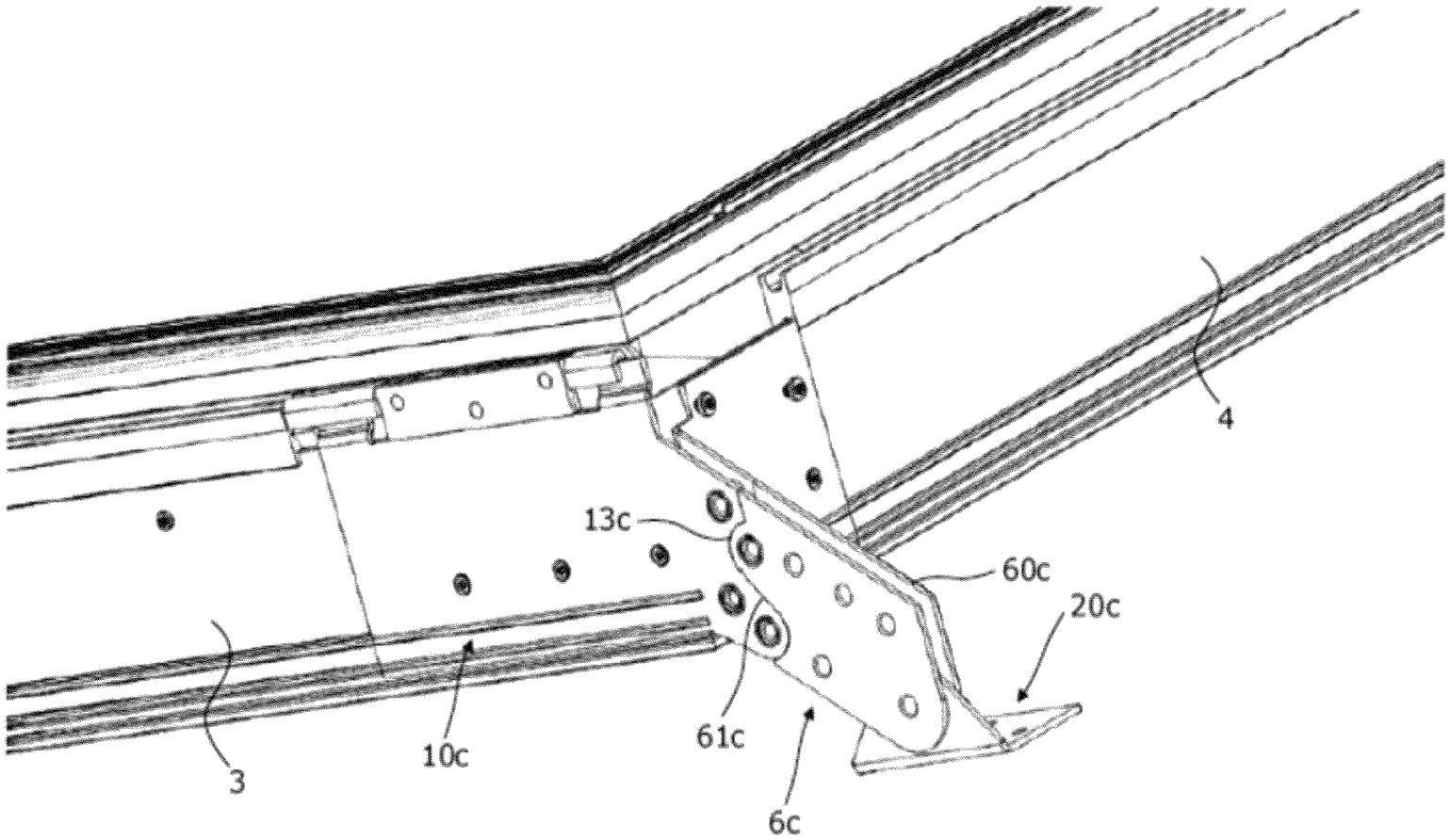
FIG. 14 is a partial perspective view on a larger scale, in another state with some parts of the window in the embodiment shown removed.
Figure 15:
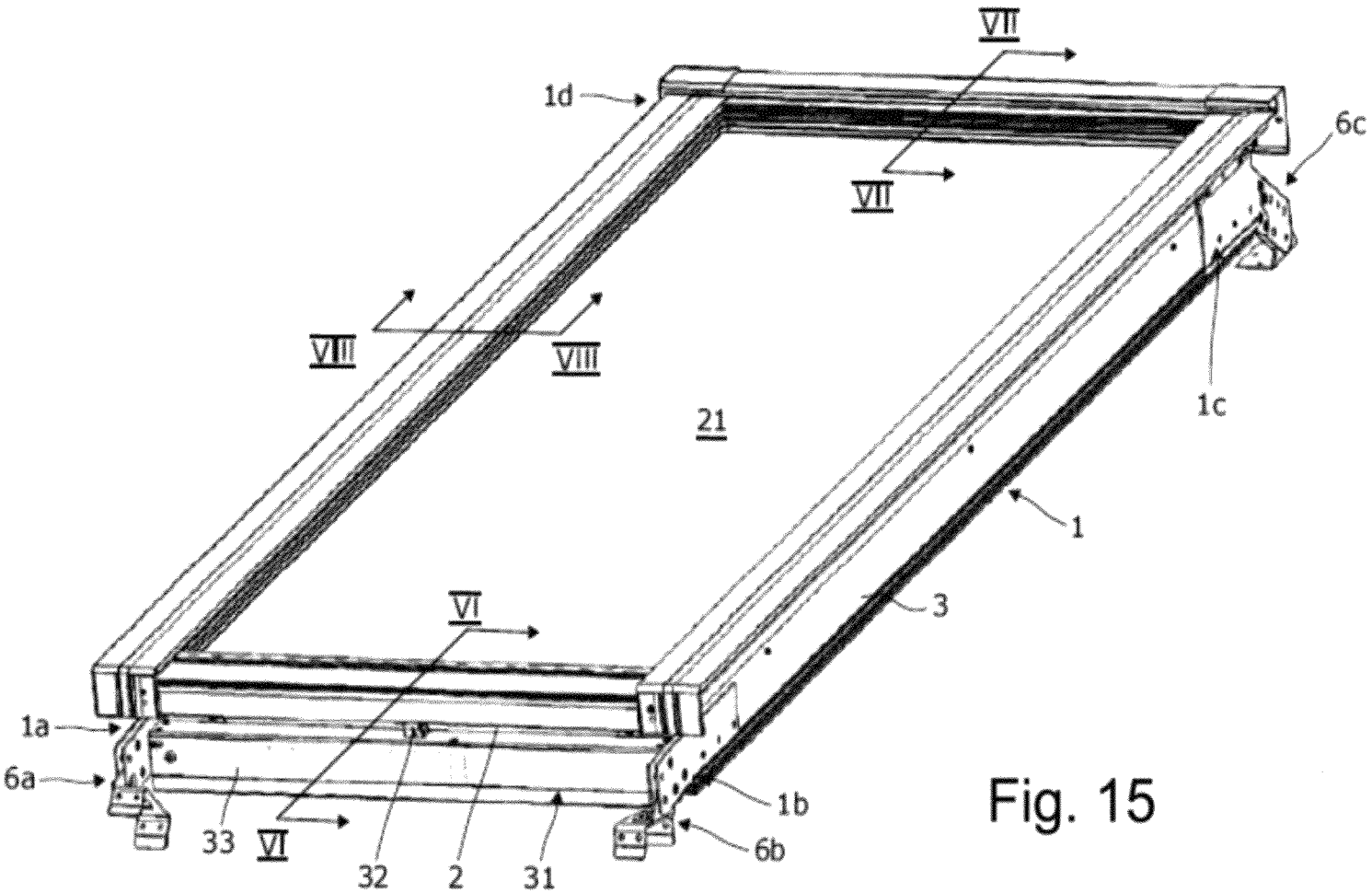
FIG. 15 is a perspective view of a window in an embodiment of the invention.
Figure 16:
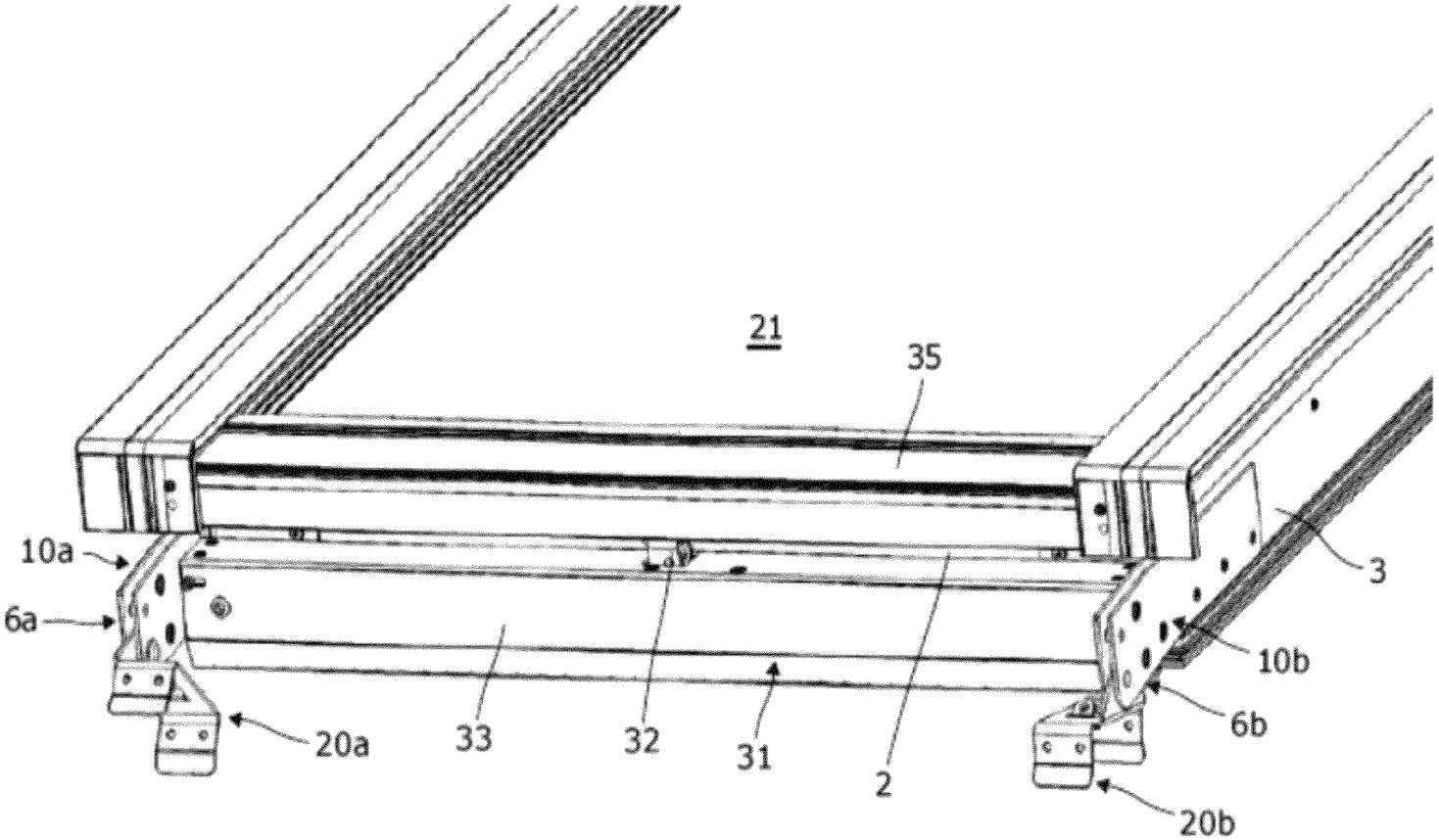
FIG. 16 is a perspective view, on a larger scale, of a window in an embodiment of the invention.
Figure 17:
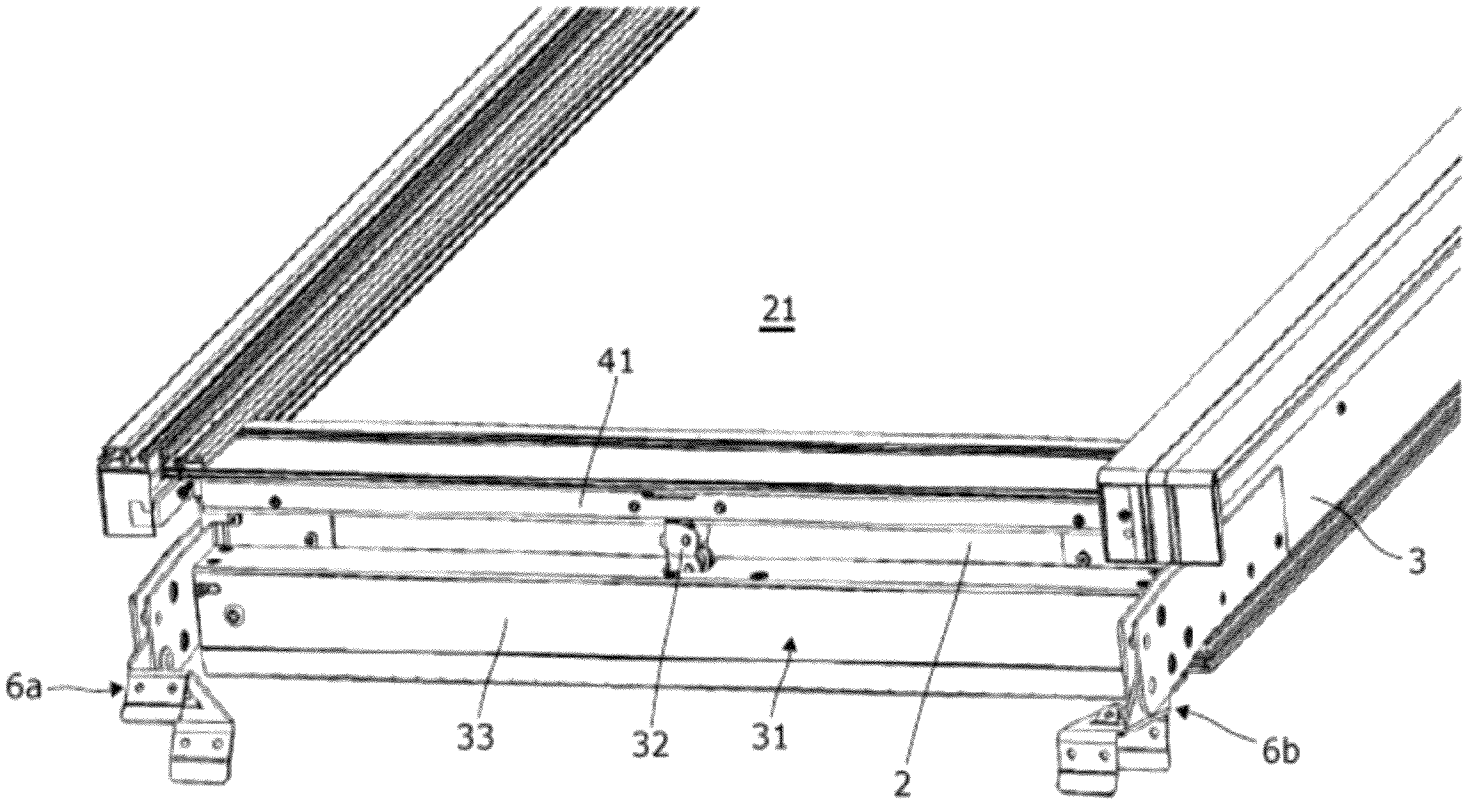
FIG. 17 is a view corresponding to FIG. 16, with some parts of the window system removed.
Figure 18:
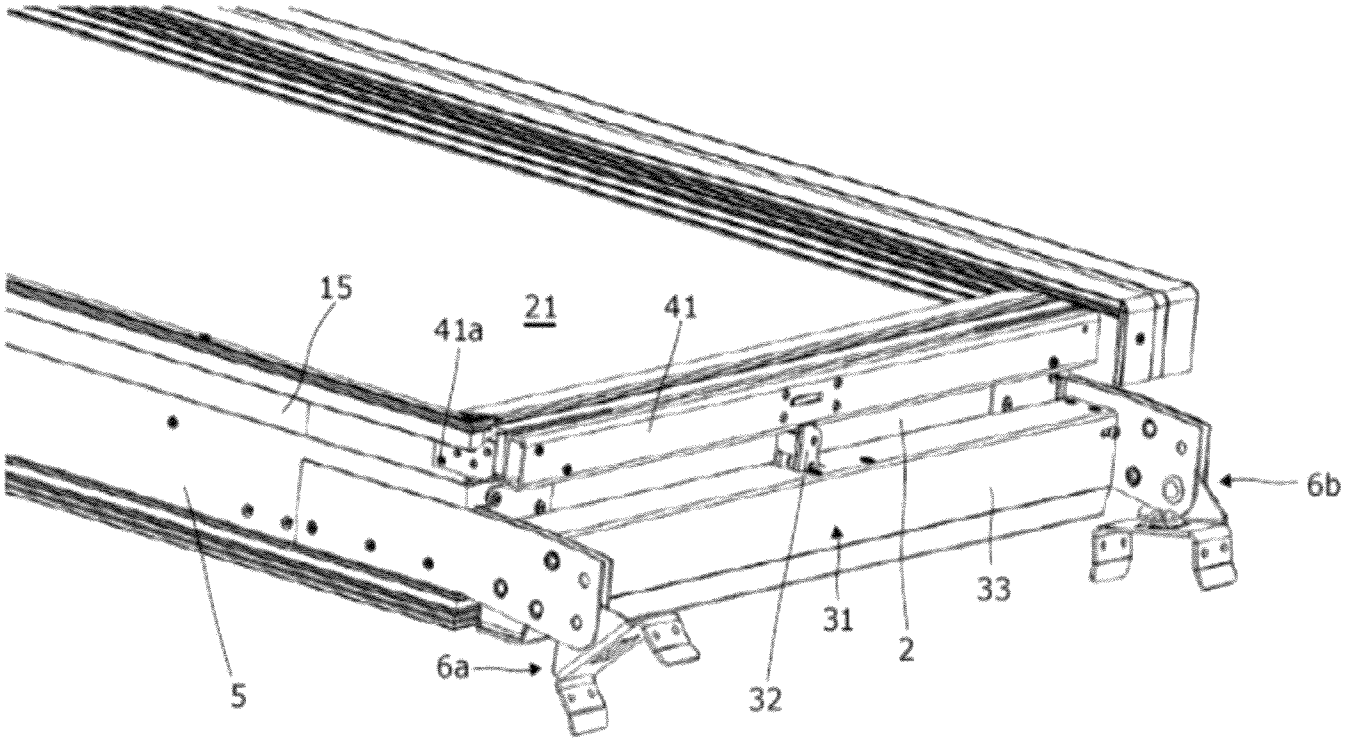
FIG. 18 is a view corresponding to FIG. 16, with some parts of the window system removed, and from a different angle.
Figure 19:
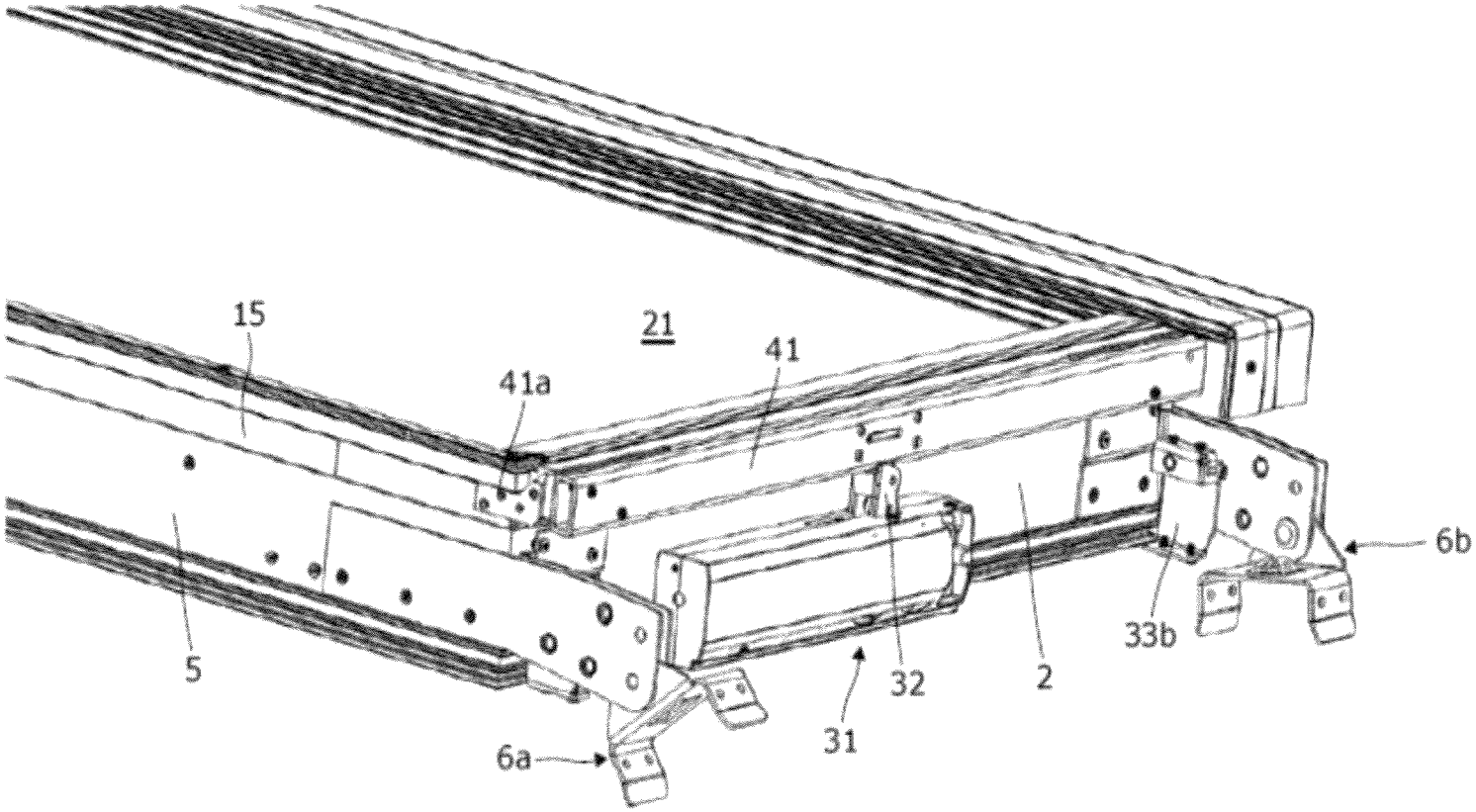
FIG. 19 is a view corresponding to FIG. 18, with some parts of the window system removed.
Figure 20:
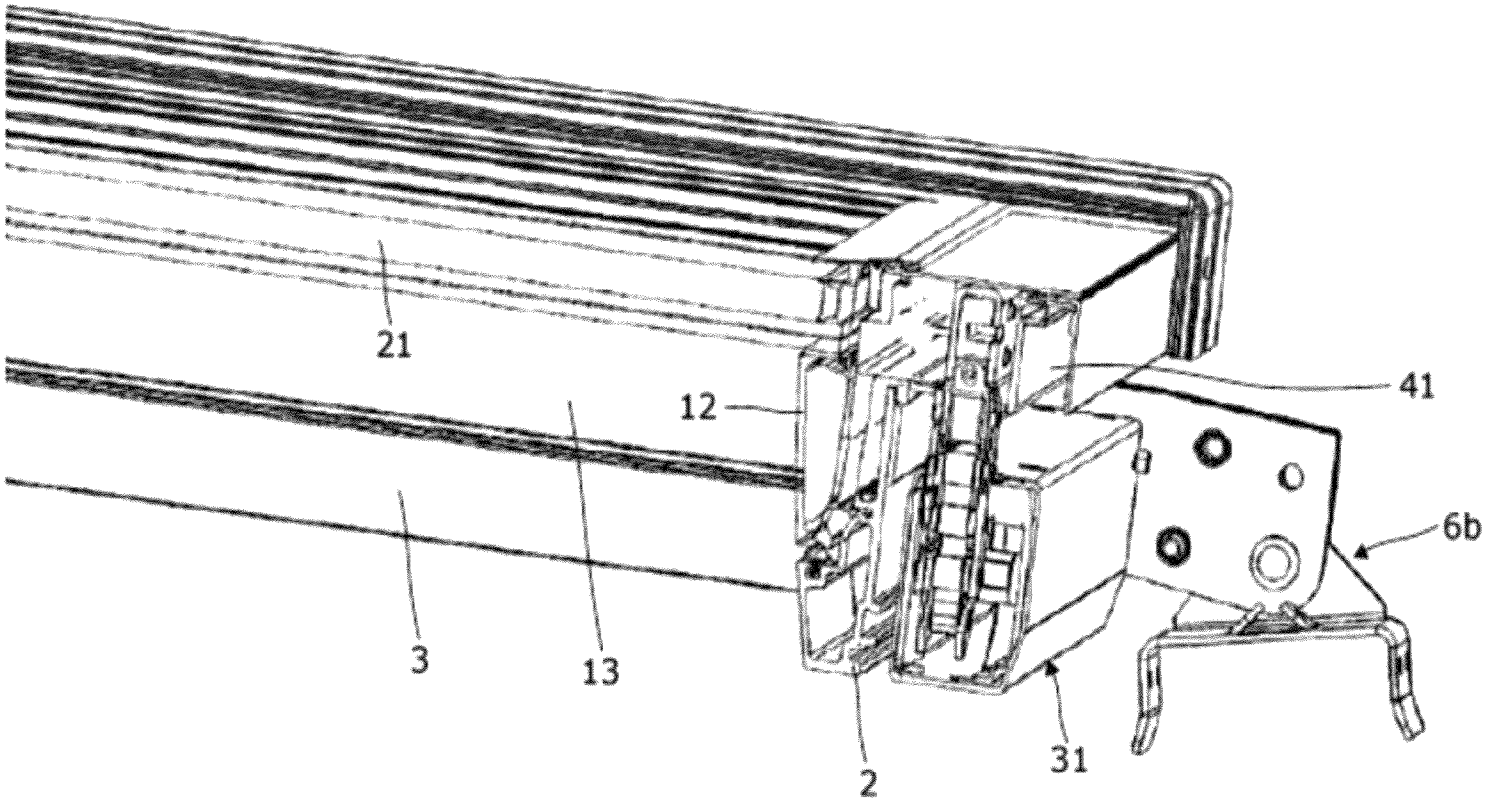
FIG. 20 is a perspective cross-sectional view substantially along the line VI-VI in FIG. 15.
Figure 21:
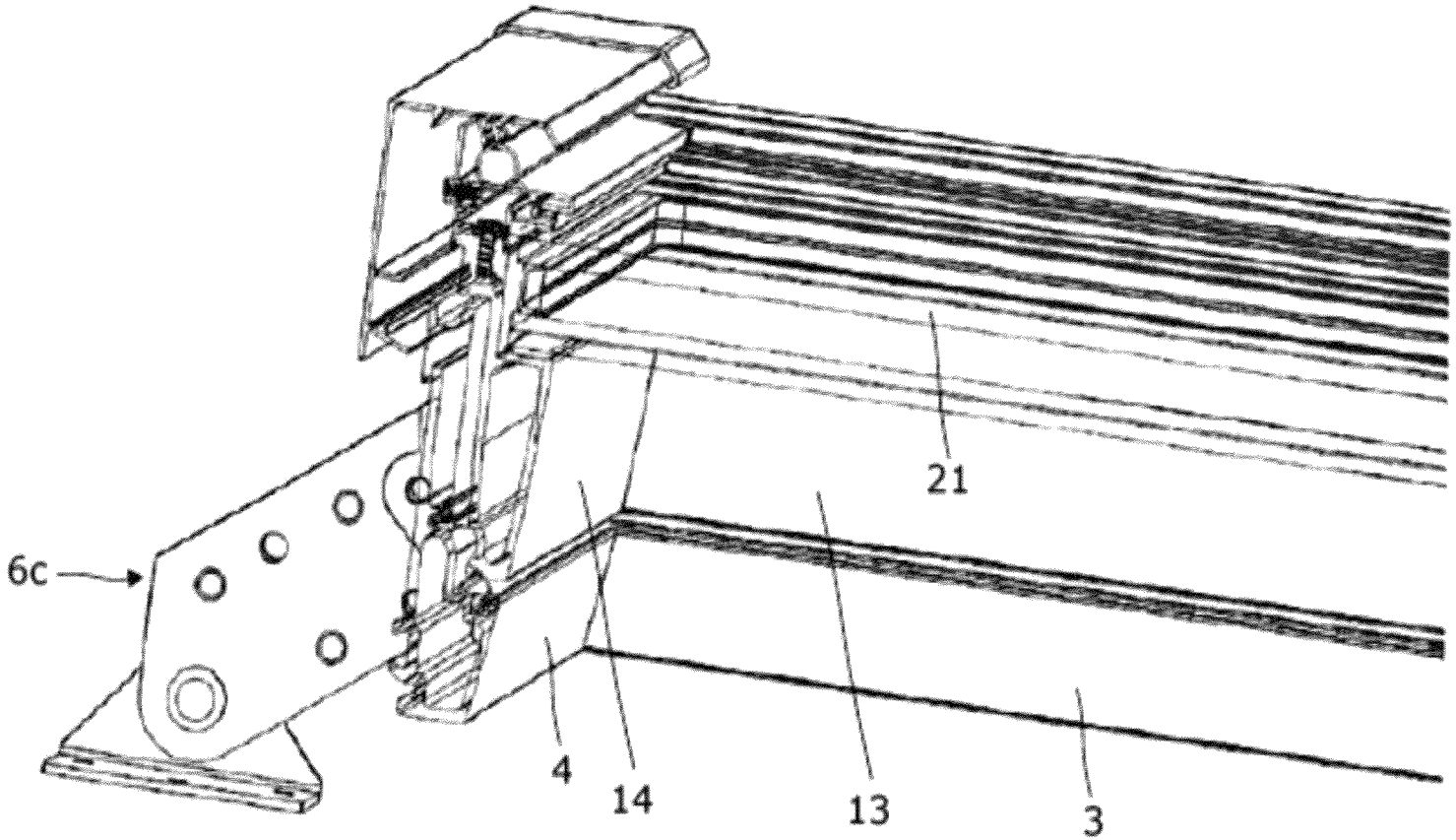
FIG. 21 is a cross-sectional view of an embodiment, substantially corresponding to a section along the line VII-VII of FIG. 15.
Figure 22:
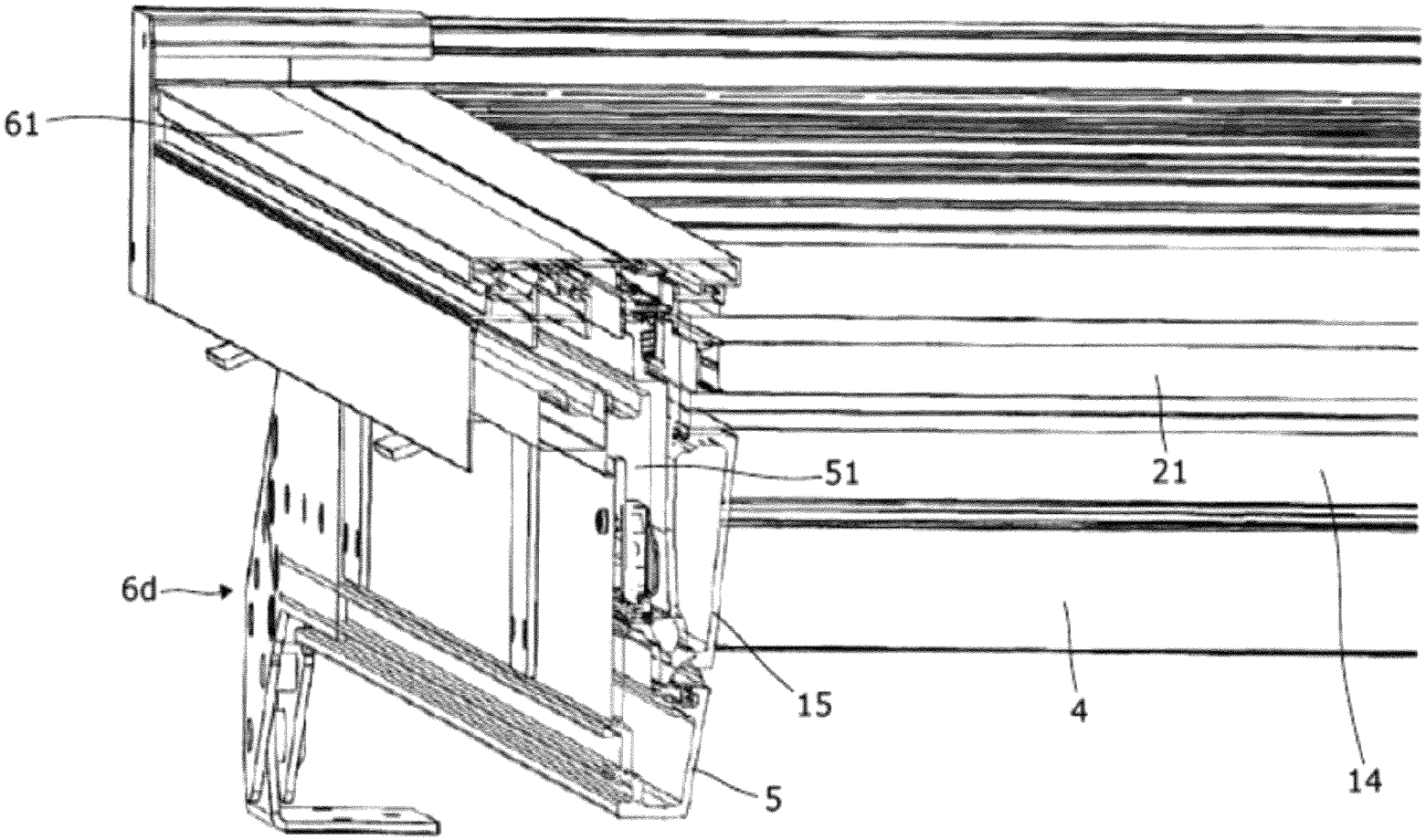
FIG. 22 is a perspective cross-sectional view substantially along the line VIII-VIII in FIG. 15, the cross-sectional view being rotated to a different angle.
Figure 23:
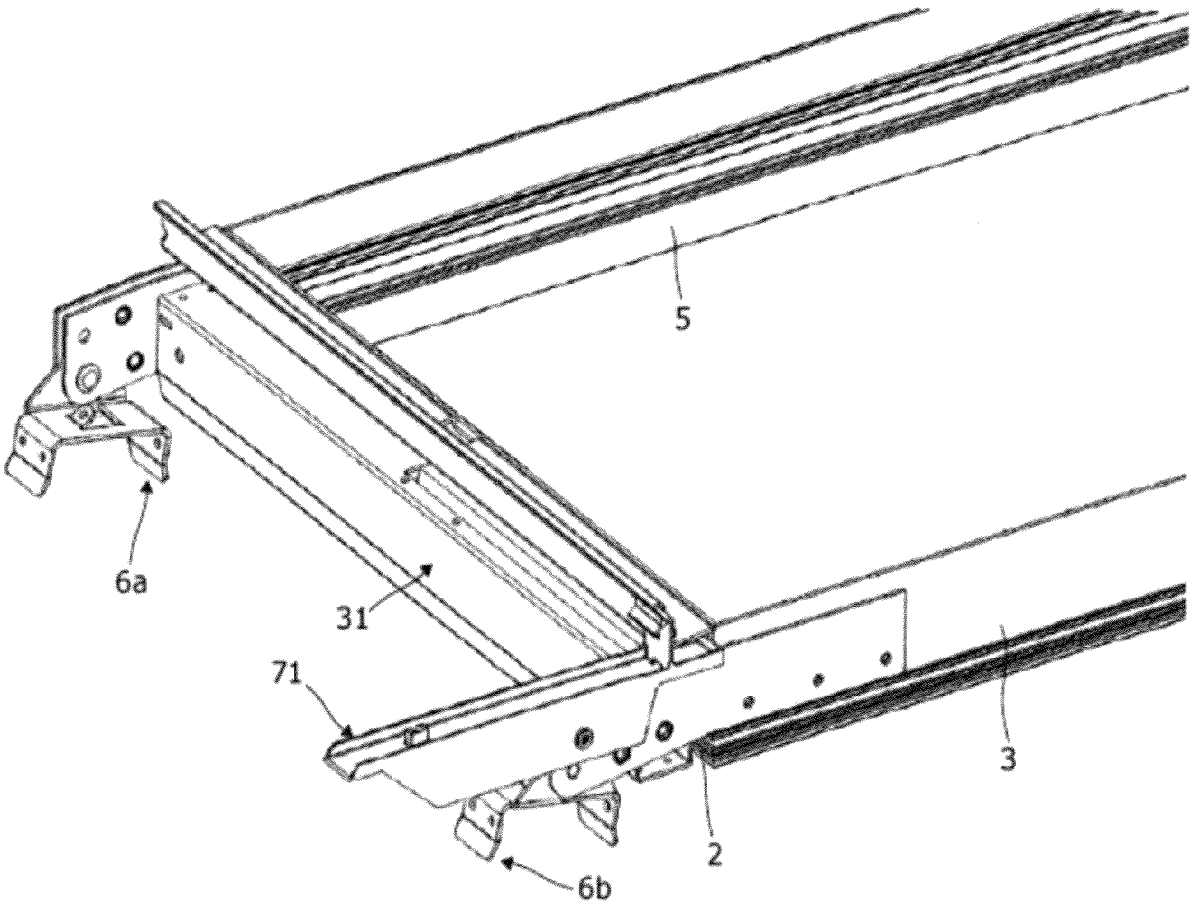
FIGS. 23 and 24 are perspective views of an embodiment of the window according to the invention and incorporating a flashing system.
Figure 24:
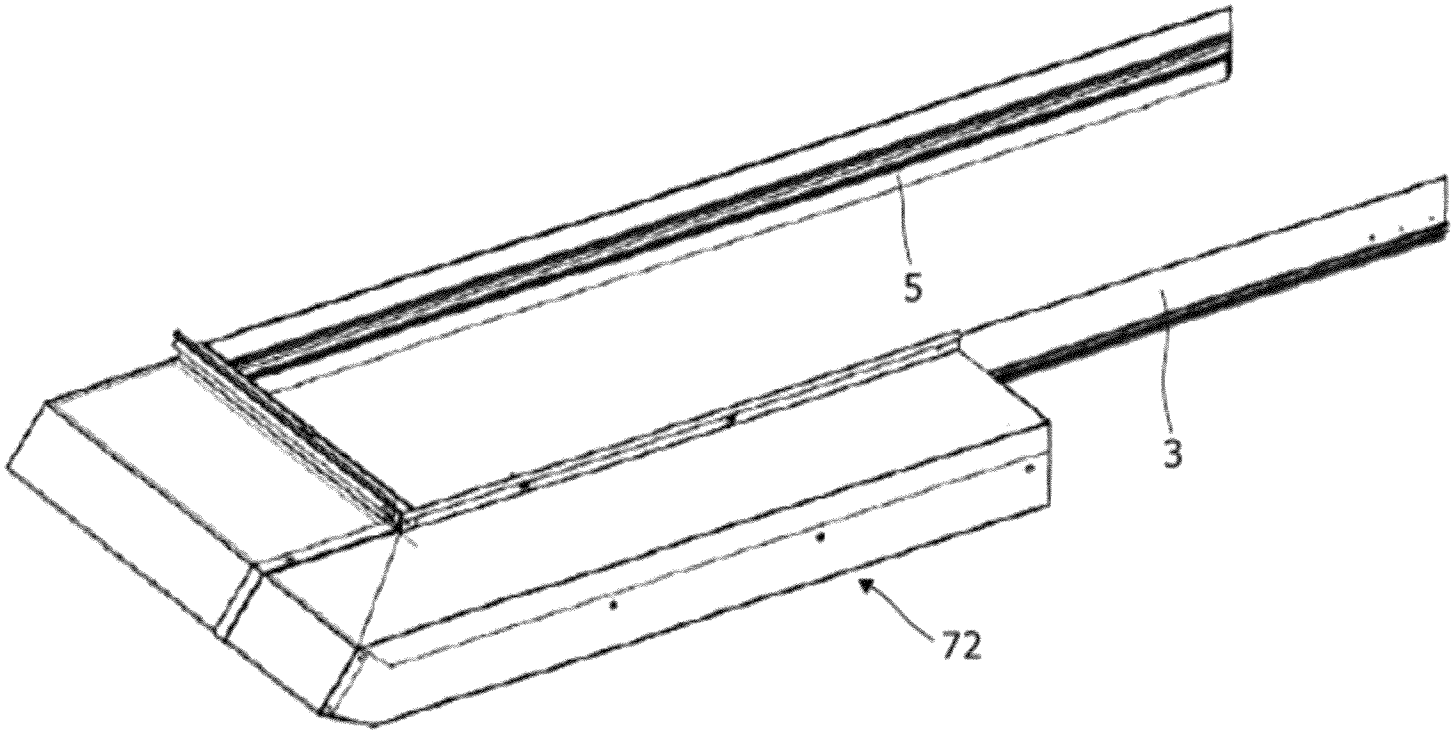

Referring to FIG. 13 showing the window in a state of delivery, the spacer elements 40*c*, 40*d* and transverse bar 45*c* have been removed, and lifting elements 50*c*, 50*d* are visible. When the window has thus been delivered and lifted up to the installation site, the lifting element 50*c* and the remaining lifting elements are removed thus attaining the state in FIG. 8, in which the window is ready to be fastened to the underlying roof structure and reach its built-in position of use. During the adaptation to the underlying roof structure, the leg elements 20*a*-20*c* are adjusted relative to the base elements 10*a*-10*d* to accommodate inclination, tolerances etc.

Referring now to FIGS. 15 to 27, an embodiment with particular focus on the operator and the hinge connection will be described in further detail. The reference numerals of this embodiment are the same for denoting elements having the same or analogous function.

A frame structure 1 of the window according to the invention has four corner sections 1*a*, 1*b*, 1*c* and 1*d* and is adapted to be installed in a roof structure (not shown). In the embodiment shown, the frame structure 1 is composed by four frame members 2, 3, 4 and 5, extending between respective corner sections. The window furthermore comprises a bracket arrangement comprising a set of bracket units 6*a*, 6*b*, 6*c* and 6*d*. In the embodiment shown, each bracket unit includes a base element 10*a*, 10*b* (only shown at the bottom of the window in the embodiment shown—base element 10*d* of the upper left-hand corner visible in FIG. 26) mounted at the respective corner section 1*a*, 1*b*, 1*c* and 1*d* of the frame structure 1. Additionally, each bracket unit comprises at least one supplemental element adapted to be detachably connected to the base element.

The individual configuration of each bracket unit of the embodiment shown will be described in some detail further down. In this description, terms such as "lower", "upper", "left-hand", "right-hand", "side", "top", "bottom", etc. refer to the shown position of the window only, and is not to be interpreted as limiting the window to use in a particular position only.

The bracket units may be provided with a number of supplemental elements. One such supplemental element may for instance, as shown at the bottom only of the window in the embodiment shown, comprise a leg element 20*a*, 20*b* which in the shown state is connected to the respective base element 10*a*, 10*b* in a manner which is rotatable and detachable, that is, the leg element may be connected and disconnected from the base element by suitable connection means and is able to rotate about an axis of rotation relative to the base element. Further conceivable supplemental elements include an adaptor element, a spacer element and a lifting element. The window is fastened to the supporting structure by means of the bracket arrangement, which thus transfers the load resulting from the weight of the window to the roof supporting structure.

The window furthermore comprises a sash structure carrying a pane element 21 and including a plurality of sash members 12, 13, 14, 15, and an operator 31 including an operator member 32 having a first and a second end and adapted to extend between the frame structure and the sash structure. In the embodiment shown, the operator 31 is mounted on the external side of a first frame member constituted by the bottom frame member 2. As indicated, the operator in the embodiment shown is a chain operator and the operator member 32 is thus a chain which is able to transfer pressure and tension during opening and closing, respectively, of the sash structure relative to the frame structure.

In the following, the operator and its connection and positioning relative to the frame and sash structures will be described in further detail. The fundamental principle underlying the invention is that the operator is mounted on the external side of a first frame member.

In this context the term "external" is used for surfaces facing away from the opening defined by the window frame, while the terms "outer" and "inner" is used to indicate that a surface faces the outside or inside of the building, respectively.

This means that the operator 31 which is positioned externally, i.e. on the side of the frame member 2 not visible from the inside, is inconspicuous and concealed from a viewer standing in the room below the window.

In the embodiment shown and described the operator 31 is connected to the bracket arrangement of the window, namely to the bracket units 6*a* and 6*b* at the bottom of the window. This makes it possible to transfer the load resulting from the weight of the sash, friction in hinges etc., directly to the bracket arrangement and further out to the supporting structure, without any load being absorbed by the frame itself. This increases the degree of freedom in designing the frame structure. In particular, it is noted that the operator in the embodiment shown is accommodated in a housing 33 extending substantially between two adjacent bracket units 6*a*, 6*b* of the bracket arrangement. The housing is rotatably and detachably connected to the bracket units 6*a*, 6*b* in any suitable manner, for instance by a hinge pin connected to the base element of each bracket unit. This allows for the operator to follow the movement of the sash when opening the sash relative to the frame.

A first end of the operator member 32 is accommodated in the operator itself and a second end of the operator member is connected to a transverse element 41 extending between sash members adjacent to the sash member opposite the first frame member, i.e. in the embodiment shown to the sash member 15 and 13 adjacent the bottom sash member 12. In this manner, the forces transmitted through the operator member to the sash are not concentrated to a single point or to a limited area which could lead to bending of the sash member in question, but instead, the forces are distributed to the adjacent sash members. The transverse element 41 is arranged to extend externally of the pane element 21 of the sash structure, and in a mechanically simple further development, the transverse element 41 is fastened to the sash members adjacent to the sash member opposite the first frame member by means of a fitting 41*a* (only the left-hand fitting visible in FIGS. 18 and 19).

The operator forms a contained unit positioned externally and is as such hidden from the inside. In case it is desired to disguise the operator further, partly from viewing, but also from direct exposure to the weathering, the operator may in the installed position of the window be at least partly concealed under cover plate 35 and a flashing arrangement 72 mounted on the frame structure 1, i.a. by means of a connector element 71. The flashing arrangement and the connector element are described in further detail in another embodiment.

In the shown embodiment, the operator is a chain operator and the operator member a chain. This provides for a particularly compact design, but other kinds of operators are conceivable as well, such as a scissors operator and a pressure medium operated opener/closer.

The window according to the invention may be used for many different geometrical configurations, e.g. an array of long lights forming a light band and ridges.

Figure 25:
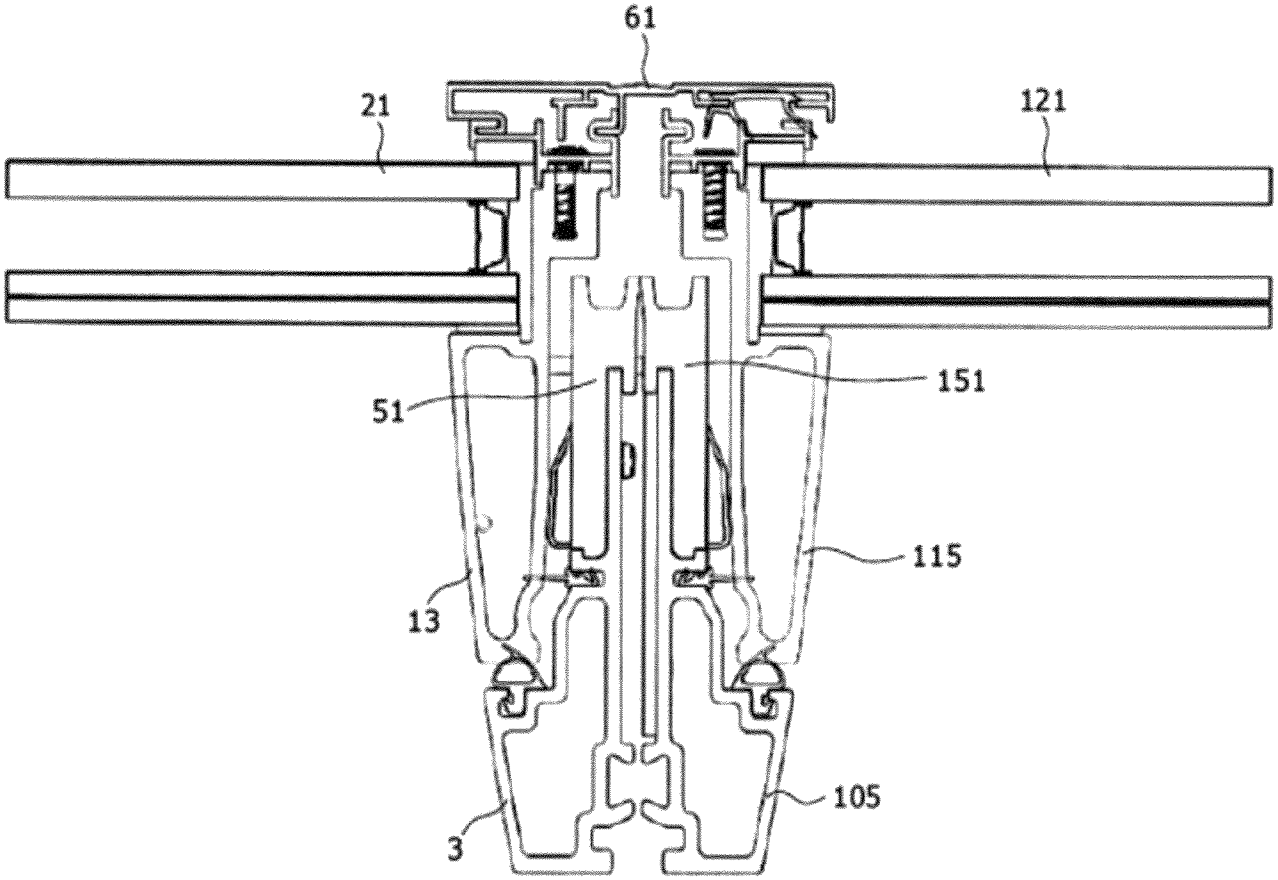
FIG. 25 is a cross-sectional view of a window according to the invention, showing two windows built-in side-by-side.

One conceivable installation situation is shown in FIG. 25, in which two windows according to the invention are built-in side-by-side. Thus the left-hand window may be as described in the above, thus showing the right-hand frame member 3, the right-hand sash member 13 and the pane element 21. To the right of the window, there is a further window, of which the left-hand frame member 105 and sash member 115 are shown. The sash member 115 carries the pane element 121 together with other sash members. A drain element 51, 151 is positioned in connection with the respective frame member 3, 105 such that they form two drain grooves positioned side-by-side. A common cover element 61 spans the gap between the adjacent sash members 13 and 115 and extends somewhat into the border portion of the respective pane element 21, 121.

The members of the frame and sash structures may in principle be formed in any suitable manner, but may preferably be formed as thin-walled profiles, such as fibre glass reinforced profiles made by pultrusion. Details of such profiles and in particular the fastening of the pane elements 21, 121 by means of glazing lists are described in further detail in other embodiments.

The hinge connection between the sash structure and the frame structure may in principle be formed in any suitable manner to provide a hinge axis at the top of the window or at another location between the top and bottom, or between the sides. However, a hinge axis located at the top of the window is preferred. The hinge connection may for instance include a hinge pin connected with the sash structure and a journal connected with the frame structure. However, one possible design is by accommodating the connection between the sash structure and the frame structure within the bracket arrangement. This is shown in detail in FIGS. 26 and 27.

Figure 26:
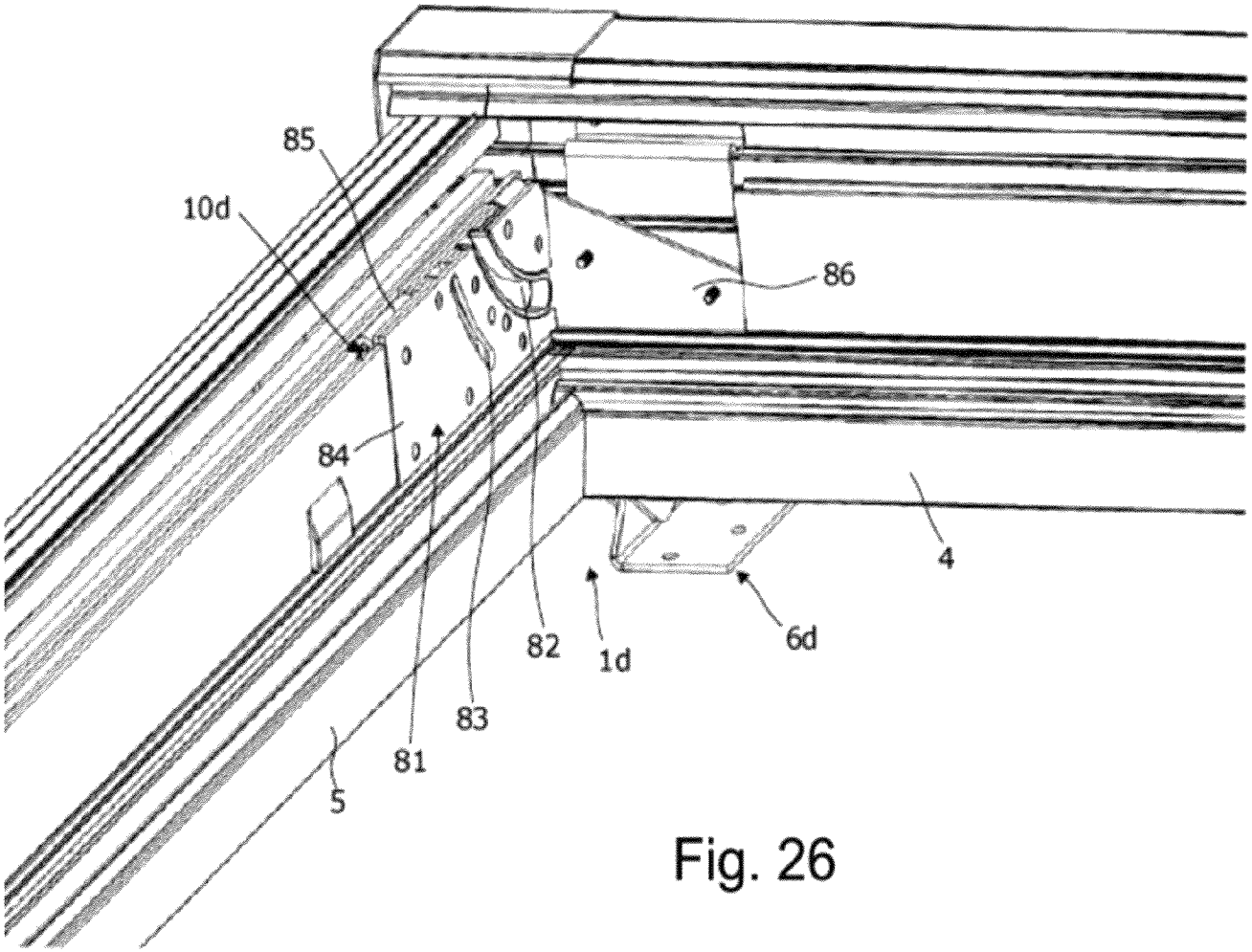
FIGS. 26 and 27 are partial perspective views of a window system in a further embodiment.

The load resulting from the weight of the sash structure, thus primarily of that of the pane element, is transferred into the supporting structure, i.e. the fixed building structure to which the bracket arrangement is fastened. A first hinge part 91 is connected to the sash structure and a second hinge part 81 is connected to the bracket arrangement, i.e. in the embodiment shown to the bracket units 6*c* and 6*d* at the top of the window. In the embodiment of FIG. 26 showing the upper left-hand corner 1*d* of the frame structure, the second hinge part 81 comprises a first guidance 82 formed as an arc-shaped recess and a second guidance 83 formed as an arc-shaped track in a plate-shaped element 84. The plate-shaped element 84 of the second hinge part 81 is connected to the bracket unit 6*d* in that a folded portion 85 of the second hinge part 81 is connected to the base element 10*d* of the bracket unit 6*d*. The folded portion 85 may either be formed integrally with the plate-shaped element 84 or connected in any suitable manner, for instance by means of rivets or screws.

Figure 27:
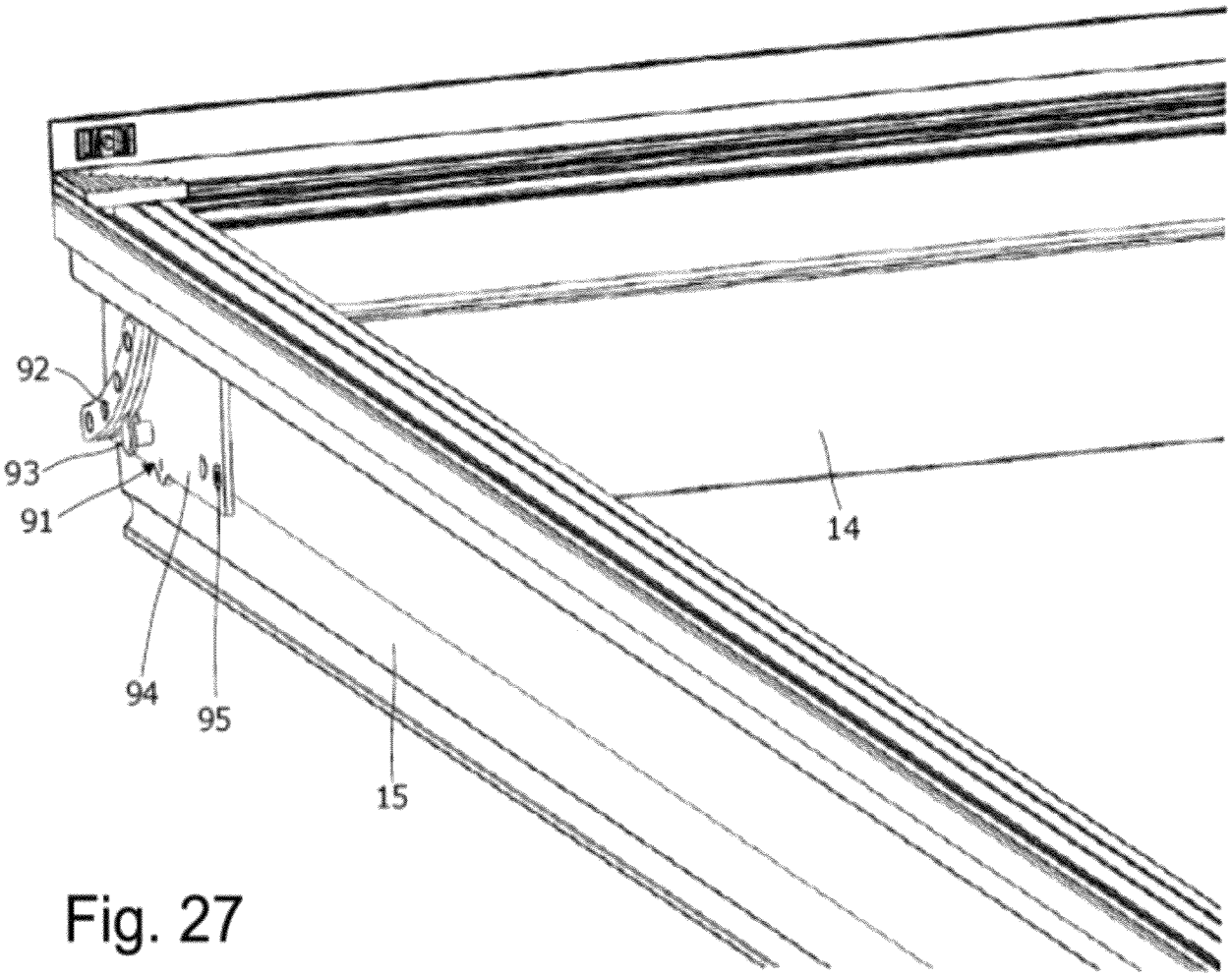

Correspondingly, as shown in FIG. 27 showing the upper left-hand corner of the sash structure, the first hinge part 91 includes a first arc-shaped arm 92 for cooperation with the first guidance 82 of the second hinge part 81. A further connection between the first and second hinge parts is provided by a stop pin 93 which in the mounted position cooperates with track 83. The arm 92 and the stop pin 93 are formed on a plate-shaped element 94 connected to the sash side member 15 by means of suitable fastening means 95 which may be screws or rivets. During opening and closing of the sash structure relative to the frame structure, the arm and stop pin of the first hinge part slide in the guidances of the second hinge part.

Figure 28:
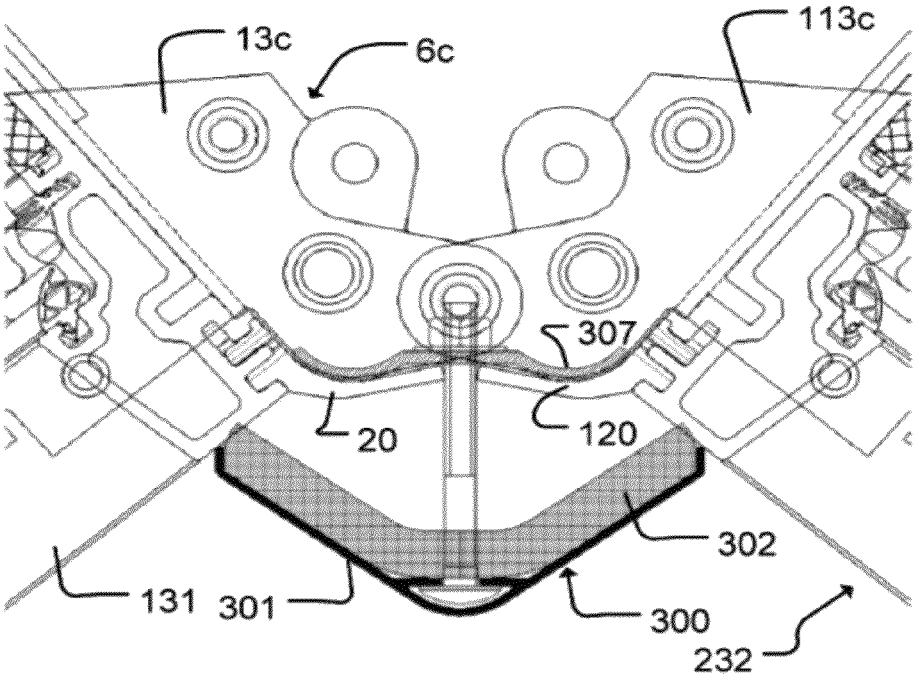
FIG. 28 shows a cross-sectional view of a detail of an embodiment of a window system according to the invention.
Figure 29:
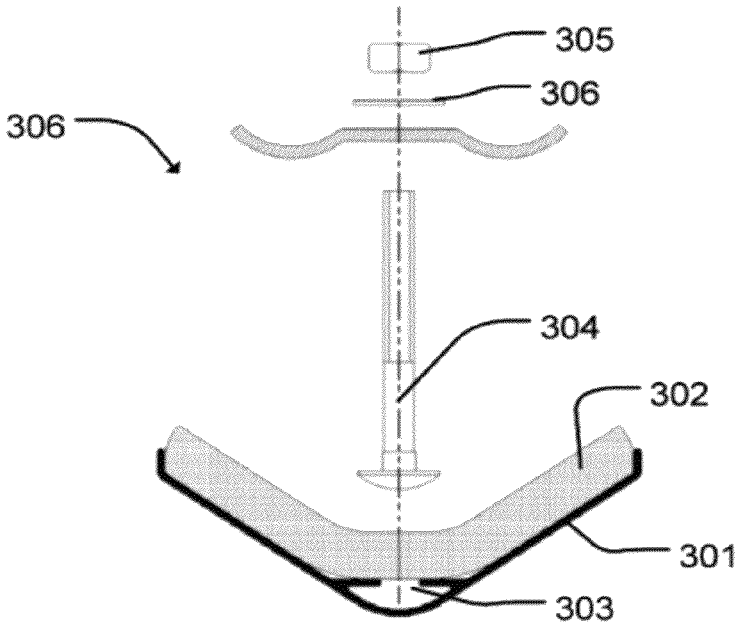
FIG. 29 shows a detail, on a still larger scale, of the window system in the embodiment of FIG. 28.

Referring now to FIGS. 28 to 31, embodiments focusing on the internal cover of the window arrangement according to the invention are described. In FIG. 28, the two windows 231 and 232 of the first set of opposed windows in the window arrangement of the embodiment of FIGS. 1 to 5 are shown. As described in the above, the bracket unit 6*c* is shown in a basic condition, i.e. comprising only base element 10*c* including its engagement means 13*c*.

The engagement means 13*c* are adapted to be connected to the engagement means 113*c* of a supplemental element constituted by the base element 110*d* of the second window 232 positioned opposite to the first window 231. An internal cover device generally designated 300 extends longitudinally in the shown embodiment of the window arrangement according to the invention.

The cover device 300 comprises a profile 301 made of e.g. aluminium to which a strip 302 of an insulating material is adhered. The profile 301 has a track 303 formed near its apex and is fastened to the opposed windows 231 and 232 by means of a bolt 304 with nut 305, washer 306 and clamping disc 307. The bolt 304 is inserted into the track 303, for instance from one of the ends of profile 301, and is inserted into a gap provided by opposed flanges 20 and 120 fastened to a respective window 231 and 232. The washer 306 and nut 305 are subsequently brought into engagement with the bolt 304. A plurality of bolts may be provided at suitable intervals along the length of the profile 301. The cover device 300 may extend substantially throughout the length of the window arrangement, or a number of shorter cover devices may be utilised.

Figure 30:
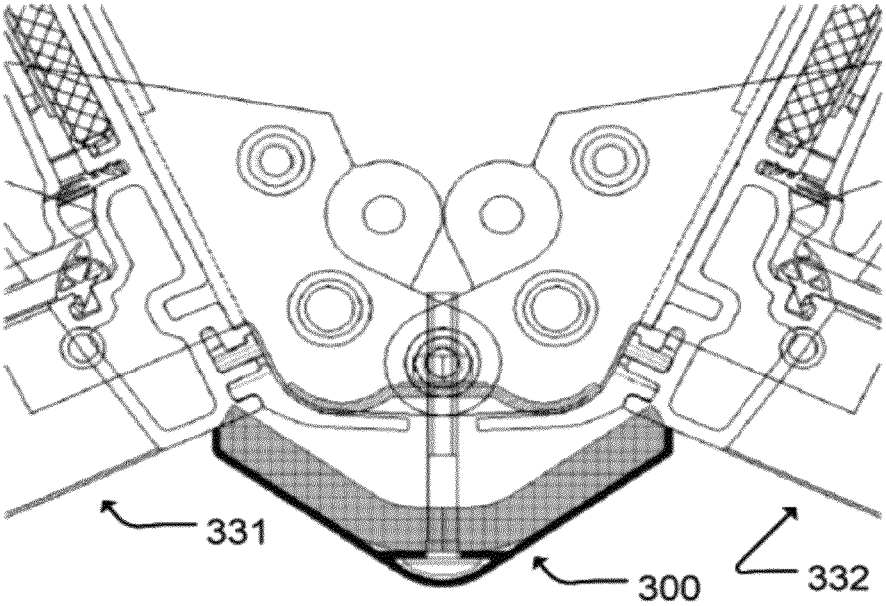
FIGS. 30 and 31 show views corresponding to FIG. 28 of embodiments of the window system mounted in other pitches.
Figure 31:
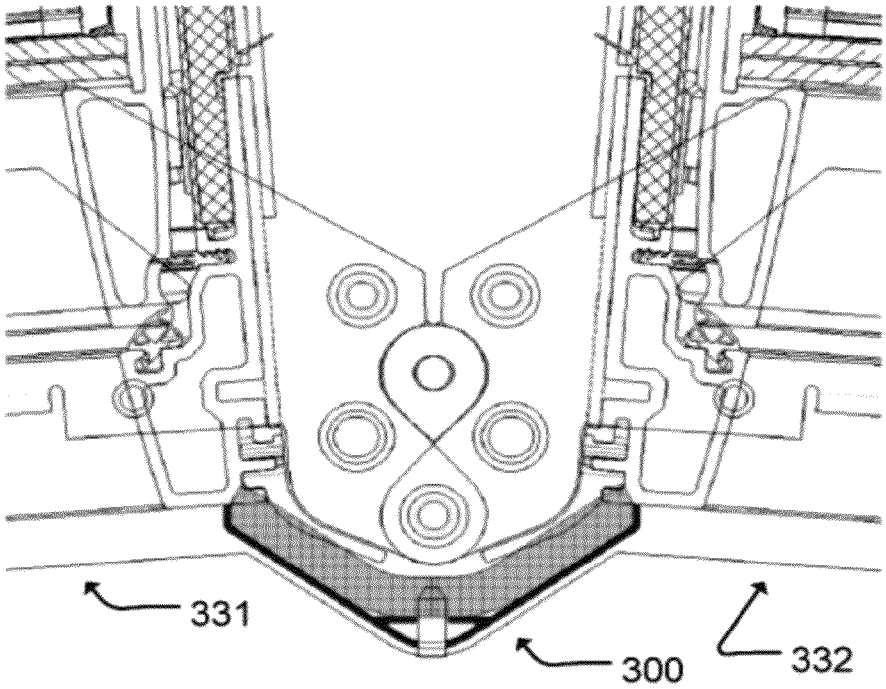

In FIGS. 30 and 31, another feature of the covering device 300 is illustrated, viz. that it may accommodate pitches within a large angle interval.

Figure 32:
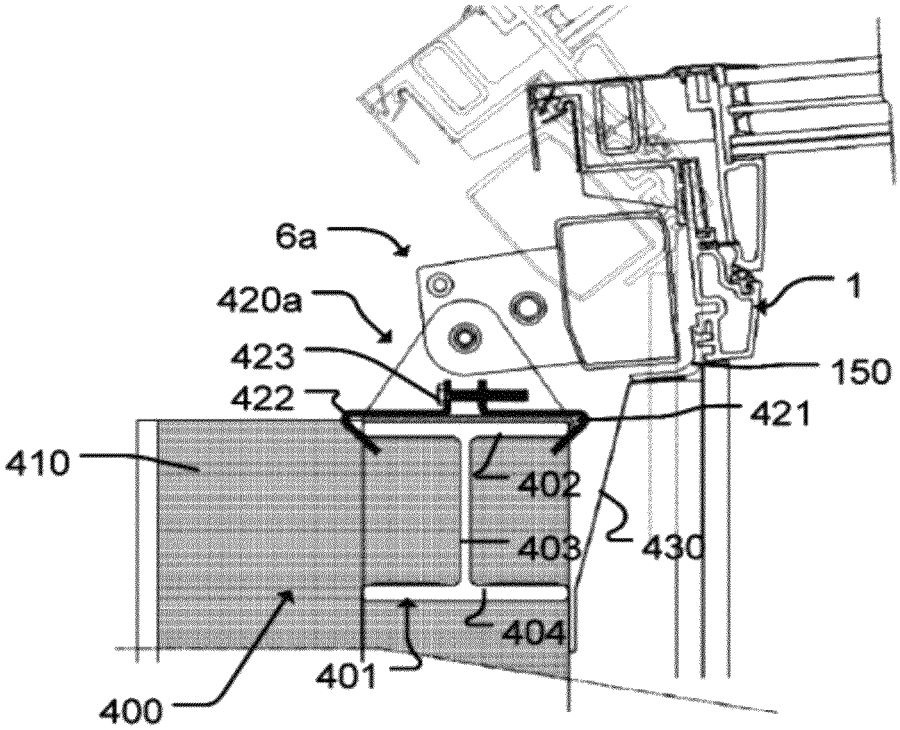
FIGS. 32 and 33 show views of details of further embodiments of the window and window system according to the invention.
Figure 33:
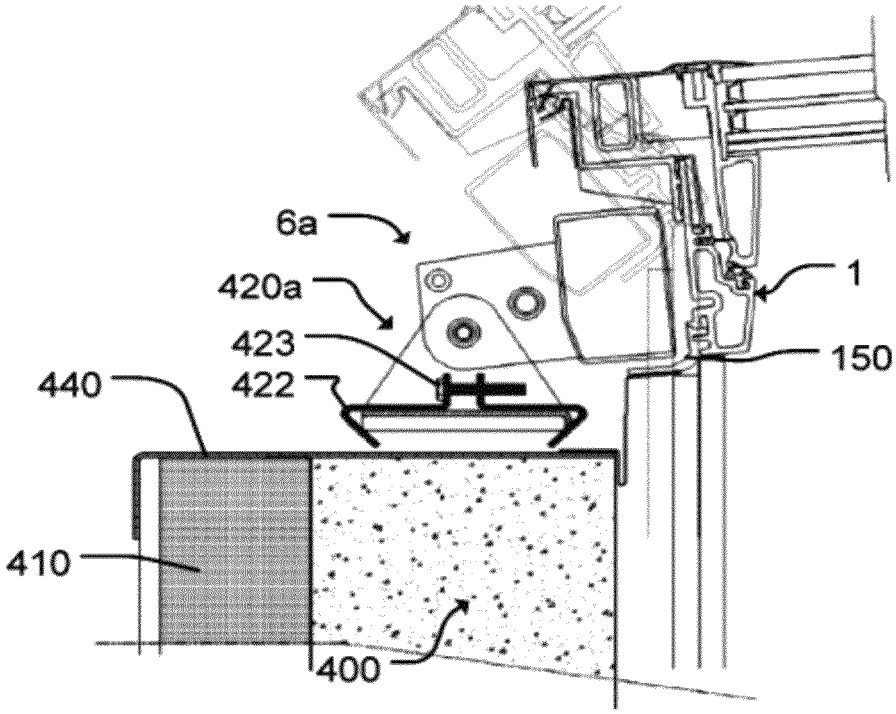

Referring now in particular to FIGS. 32 and 33, embodiments of the window in another aspect will be described in further detail.

A frame 1 of a window, which may for instance be one of the windows 231-236 of the window arrangement of FIGS. 1 to 5, is resting on an upstand 400 on a roof surface (not shown). As described in the above, the frame 1 is connected to the surrounding roof structure, i.e. the upstand 400, by means of a bracket unit 61 connected to a leg element 420*a*. On the upstand 400, an I-beam 401 with an upper flange 402, a web 403 and a lower flange 404 is mounted in any suitable manner. In this embodiment, the bracket unit 6*c* is shown as having a pivot joint to the leg element 420*a*, but other types of bracket units may of course also be employed.

The leg element 420*a* is connected to the I-beam 401 by means of a clamping device comprising two parts 421 and 422 clamping the leg element 420*a* to the I-beam 401 by engagement with the upper flange 402 of the I-beam 401. Furthermore, an insulating portion 410 of the upstand 400 is indicated, just as a barrier element 430 extending from a flange 150 connected to the frame 1 to the lower flange 404 of the I-beam 401.

FIG. 33 shows an alternative to the above embodiment, in that the upstand 400 with an insulating portion 410 is covered by a layer 440 of a roofing material such as a bituminous felt. The barrier element 430 extends from the flange 150 connected to the frame 1 to the layer 440. In this embodiment, the I-beam is replaced with another type of beam element 450 connected to the upstand 400 in a suitable manner (not shown).

Figure 34A:
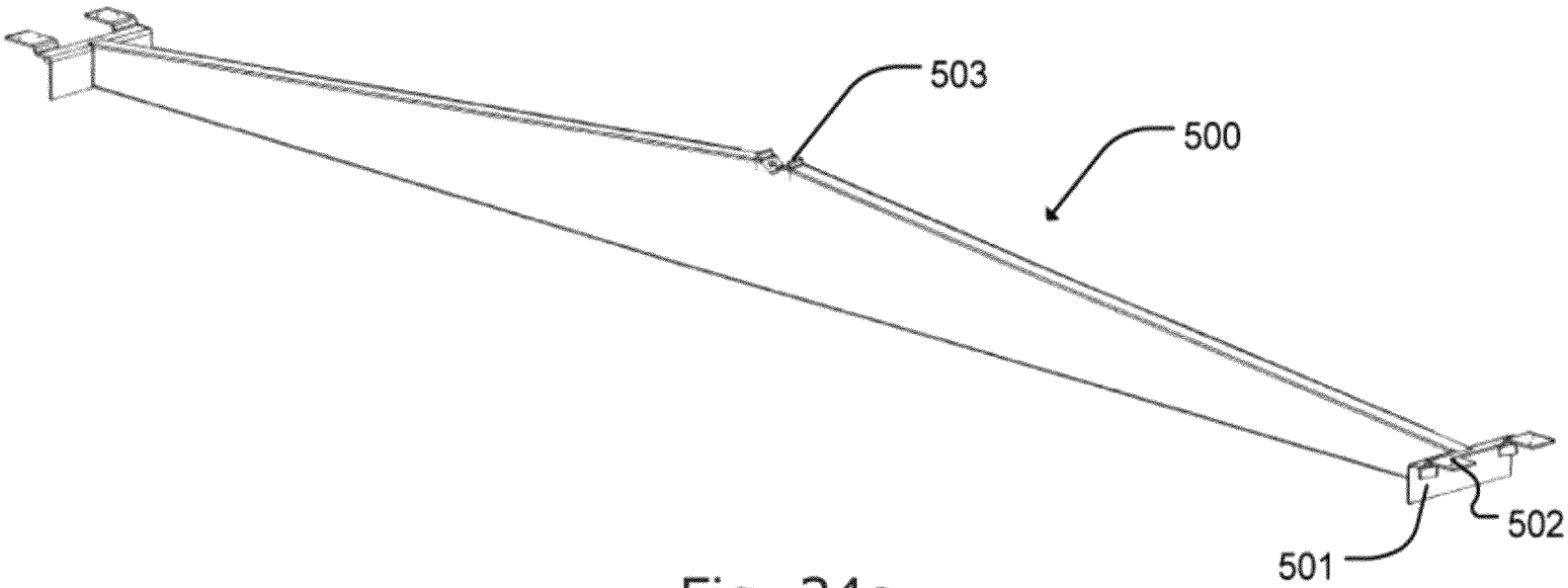
FIG. 34*a* shows a perspective view of a detail of a window system in a still further aspect of the invention.
Figure 34B:
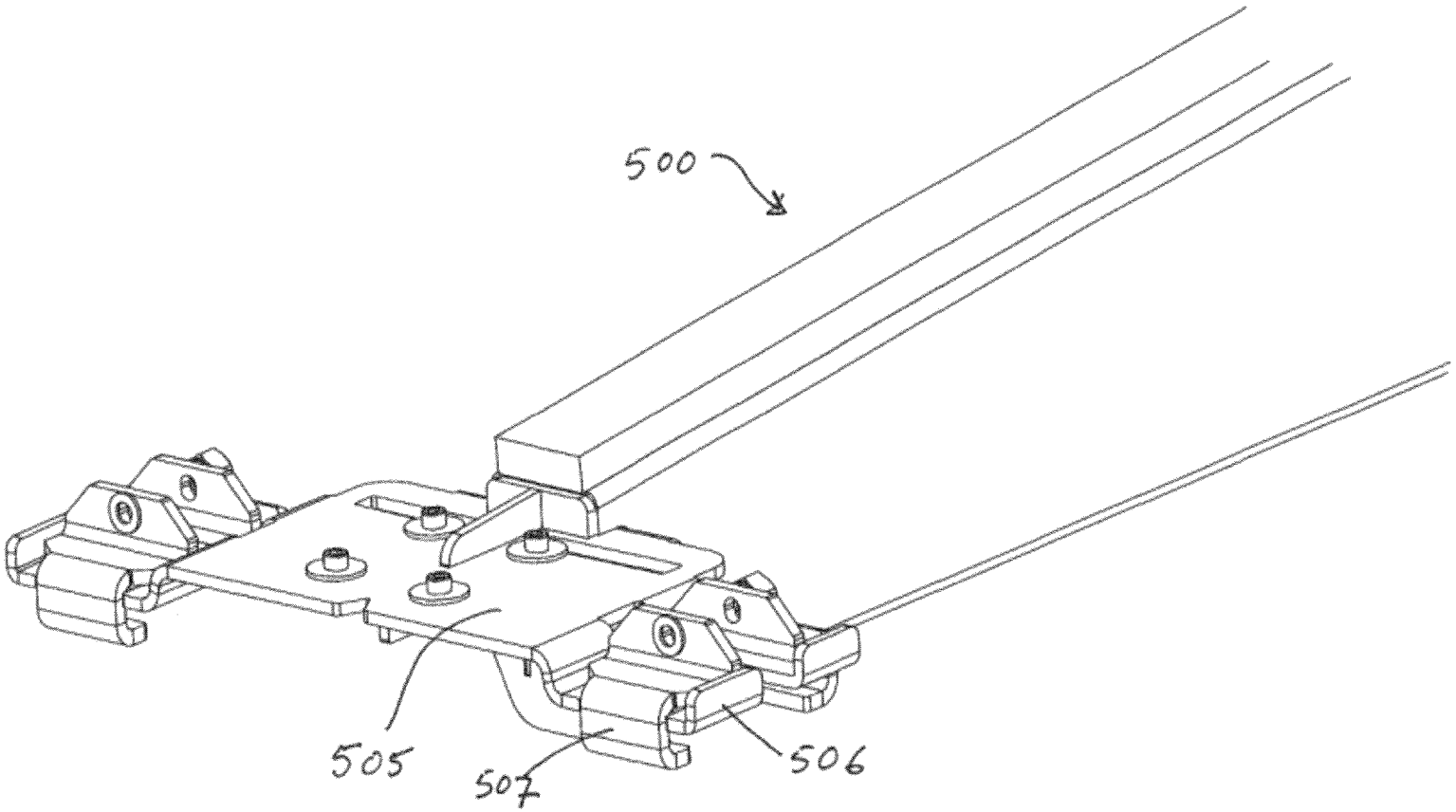
FIG. 34*b* is a perspective partial view, on a larger scale of an alternative embodiment of the detail shown in FIG. 34*a;*

Finally, an embodiment of a detail of a further aspect of the invention is shown in FIGS. 34*a* and 34*b*.

In the case of ridge constellations having a low pitch, for instance 5°, special arrangements may be desirable or necessary. In this case, the load on the window arrangement resulting not only from the weight of the windows, but in particular the wind load, may be so substantial that it is not desirable to make use of solely the self-supporting feature provided by two opposed windows.

Thus, a separate rafter or truss element 500 as shown in FIG. 34*a* may be utilised between adjacent sets or pairs of windows.

The rafter element 500 may for instance be made as a welded hollow profile of a suitable material, for instance steel.

In the embodiment shown in FIG. 34*a*, at each end of the longitudinal ends of the rafter element 500, a foot flange 501 with two protruding flanges 502 is provided. The foot flanges 501 and its protruding flanges 502 are adapted to abut on the upstand and/or a beam element on the supporting structure and secure that the rafter element 500 does not tilt during installation. Fastening of the rafter element 500 to the upstand and/or beam element may be carried out by inserting screws through openings (not shown in detail) in the protruding flanges.

In the alternative embodiment shown in FIG. 34*b*, a foot flange 505 is provided with stepped portions 506 on either side to be positioned on the upstand and fixed by means of clamping members 507.

At the centre of the rafter element 500, a gutter-like recess 503 is formed for abutment of the respective top of windows positioned opposite each other and next to each other. The gutter-like recess 503 may be provided with engagement and centering means, for instance in the form of protruding pegs (not shown) to cooperate with the windows.

A rafter element 500 may be positioned between each neighbouring pairs of windows, or rafter elements may be positioned only between selected pairs of windows.

One alternative method of installing a window arrangement, comprises the steps of providing a support structure and then mount a number of rafter elements, to which the windows are connected.

In another alternative method of installing a window arrangement, a mounting beam device is used instead of the movable gable element.

In a third alternative method of installing a window arrangement, an array of neighbouring windows is provided to form a longlight configuration.

In all of the above installation methods, it is important that neighbouring windows are connected to each other as will be described in further detail below.

Each window is provided with a plurality of predefined connection points. In the embodiment shown and described, the predefined connection points include the bracket units and a number of connection points along the length of the side frame members.

Figure 35:
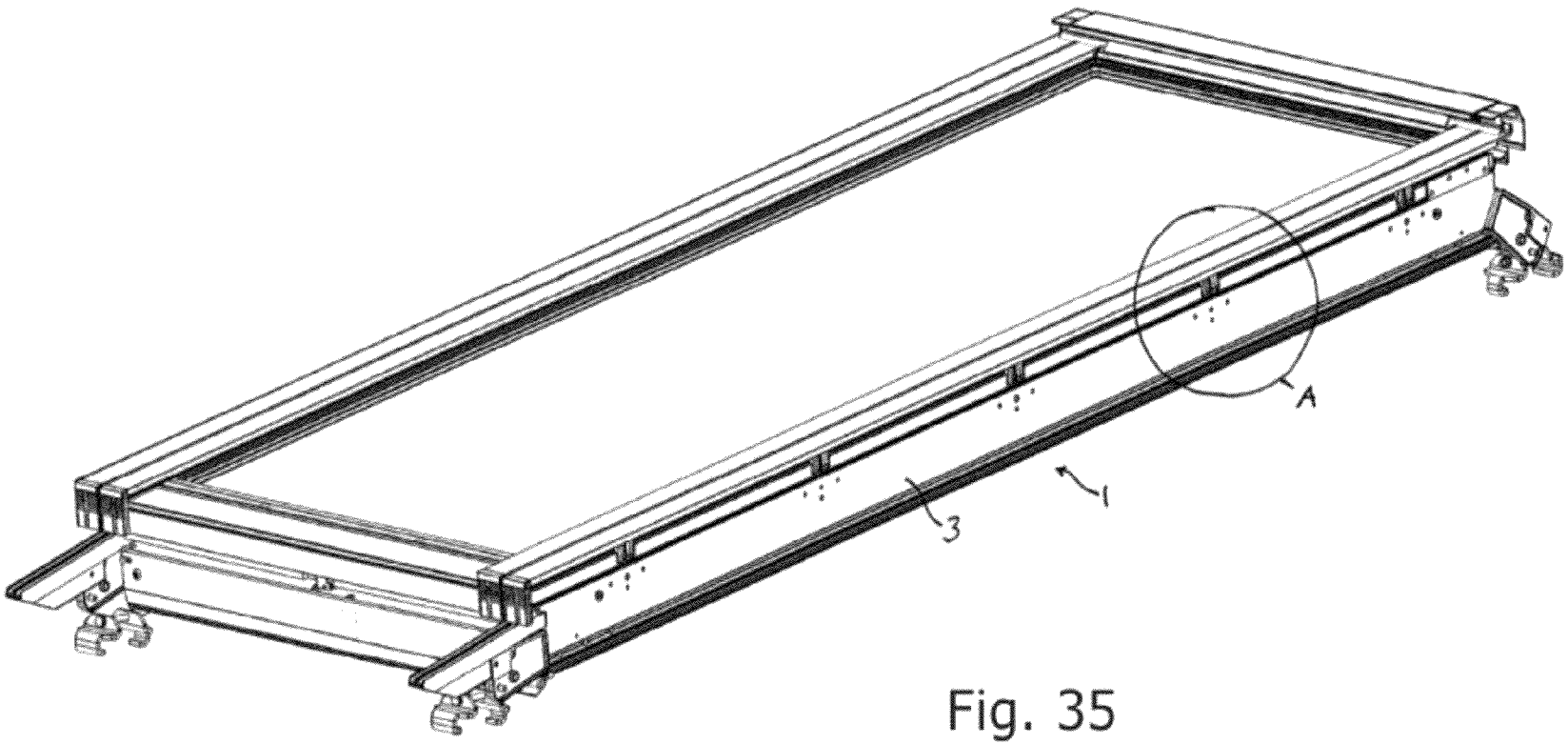
FIG. 35 is a perspective view of a window in an embodiment of the invention.
Figure 36:
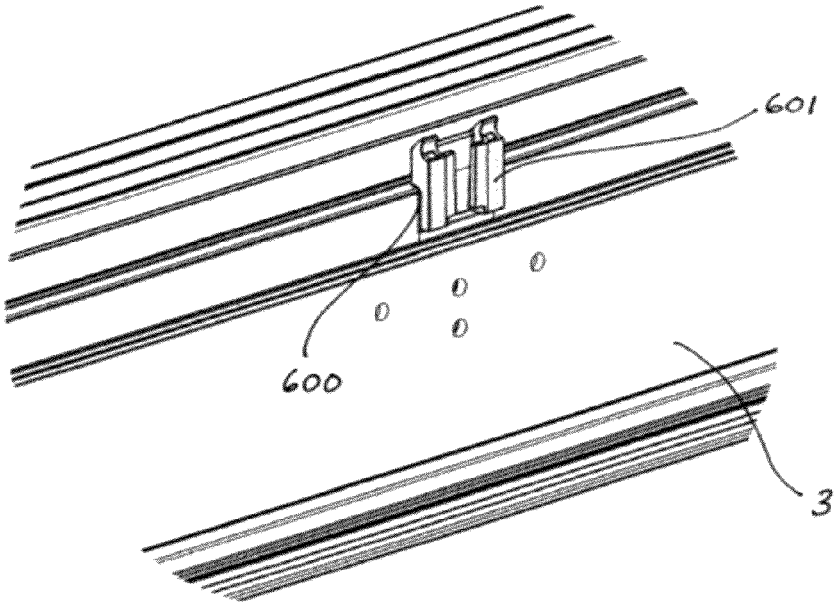
FIG. 36 is a partial perspective view, on a larger scale, of detail A of FIG. 35.
Figure 37:
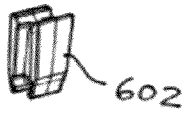
FIG. 37 is a detail of the embodiment shown in FIGS. 35 and 36.
Figure 38:
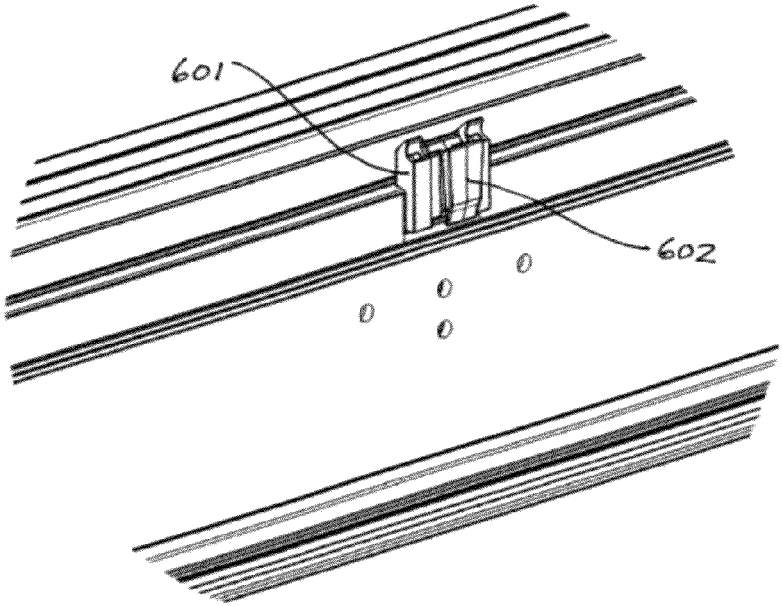
FIG. 38 is another detail of the embodiment shown in FIGS. 35 and 36.

When the windows have been connected to the support structure, and the opposed windows of each set have been connected to each other, windows of neighbouring sets are connected to each other. This is preferably done by means of sets of connection brackets as shown in FIGS. 36-38, FIGS. 36 and 38 showing the detail A in FIG. 35. The sets of connection brackets are positioned in the connection points distributed evenly along the length of the side frame members. Each set of connection brackets include a pair of first parts to be attached to the frame and a second part to be connected to each of the first parts of said pair.

As may be seen, each set of connection brackets includes, in the embodiment shown, two female parts 601 attached one to the frame of each of the windows, in the embodiment shown in a recess 600 in the side frame member, and a male part 602. The male part is U-shaped with two legs projecting downwards on the drawing. When the windows are arranged closely side-by-side and the legs of the male inserted into corresponding openings in the female parts, the windows are prevented from moving away from each other.

Figure 39:
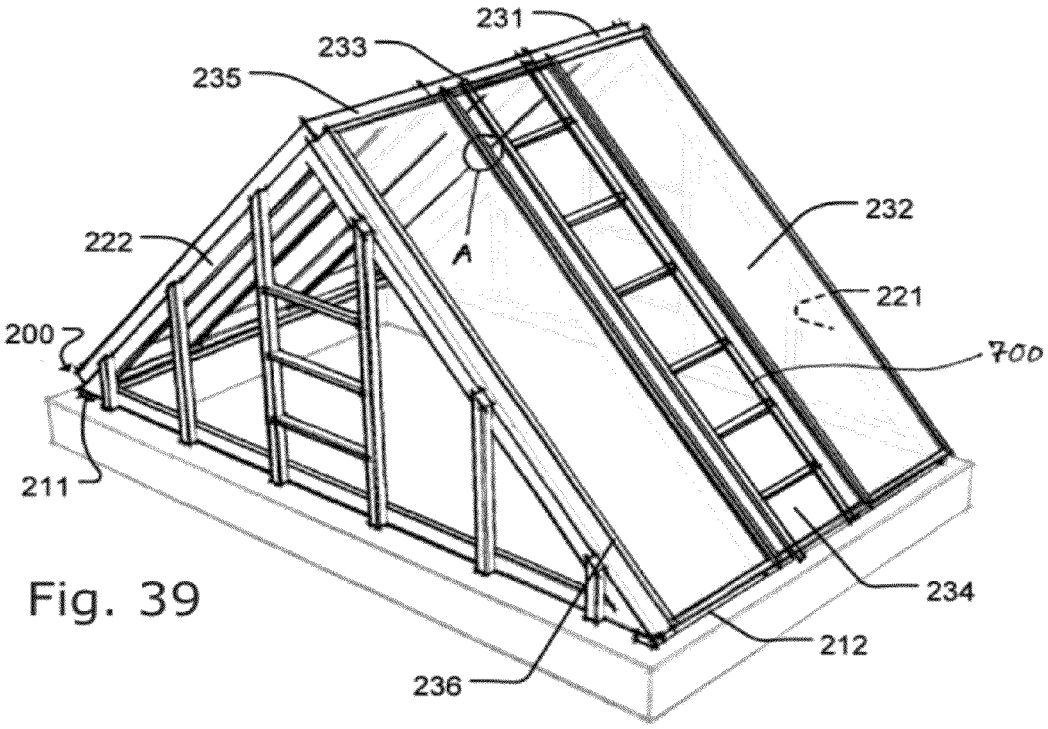
FIG. 39 shows a perspective view of an embodiment of a window arrangement according to the invention during one step of an embodiment of a method of installing the window system according to the invention.
Figure 40:
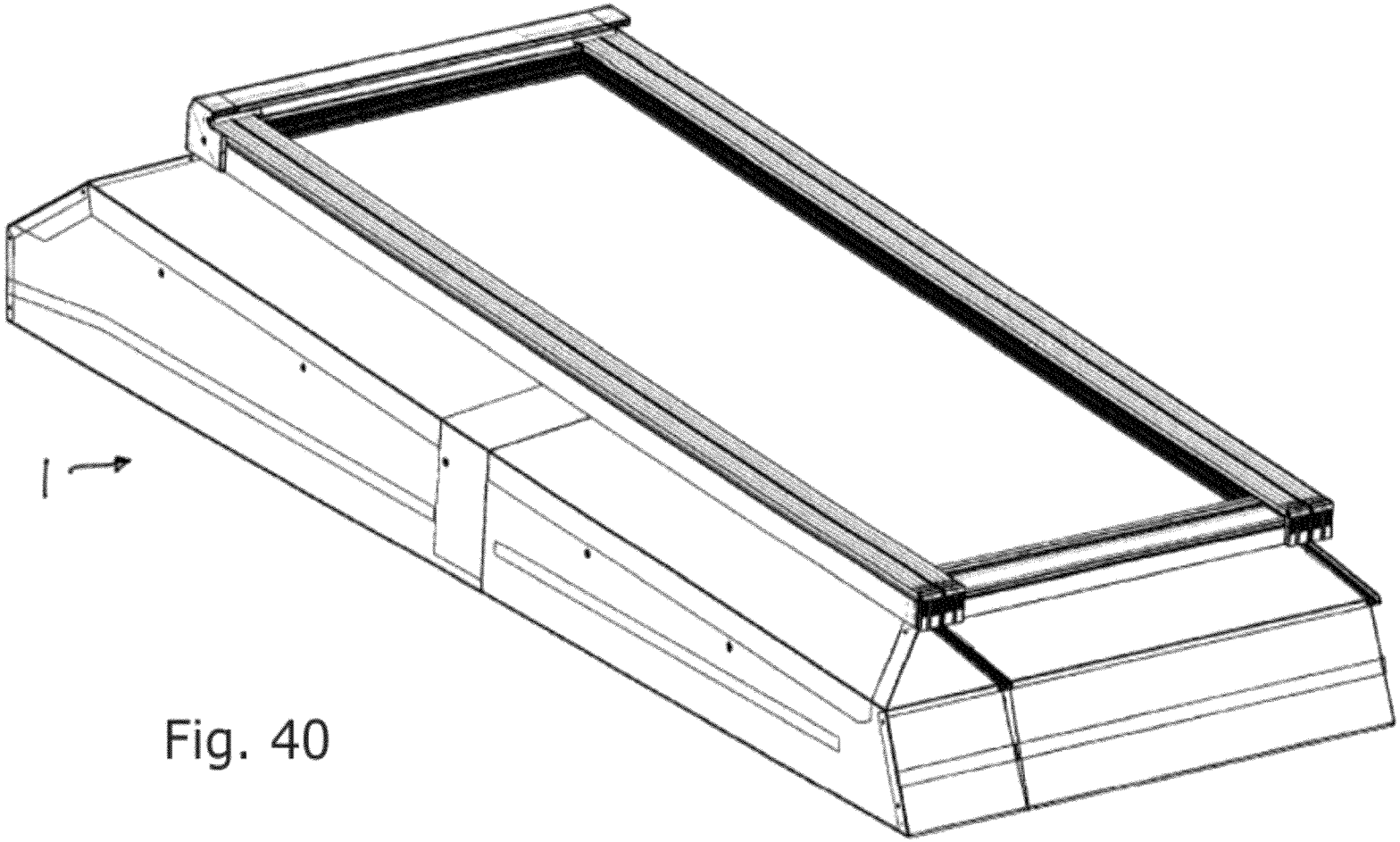
FIG. 40 shows a perspective view of a detail of a window arrangement in an embodiment of the invention.

In case the windows have a substantial length, such as more than 1 m, the connection points may not be reached or only reached with difficulty for mounting of the male parts. In this case, a ladder 700 may be placed as shown in FIG. 39, following which the male parts located far from the bottom (for instance as indicated by detail A) may easily be reached.

One or both of the legs of the male part are preferably provided with projections adapted to lock into matching recesses in one or both the female parts. The male part and/or female parts may be made at least partially resilient so that it may yield and then snap into engagement with the other part. This is preferably achieved by making the connection brackets from an elastic material and with weakening zones concentrating the bend to predetermined areas of the bracket.

In the embodiment shown in FIGS. 37 and 38, the male part is relatively weak at the part interconnecting the legs, meaning that when legs of the male part are forced into the openings in the female parts, the legs are forced apart deforming the interconnecting part. In this embodiment, the openings in the female parts are downwards open passages, which are and somewhat shorter than the legs of the male part, and the legs of the male part have slight inwards bends at their distal ends. These distal ends come to project through the lowermost opening of the passage in the female part and the bends contributes to keeping the male part in place once mounted.

Preferred materials providing the needed elasticity include plastics, such as polyethylene, and metals, such as aluminium, but composites may also be used.

The number of sets of connection brackets to be used depends on the size of the window, but it is preferred to use at least two. As an example, the window in FIG. 35 is provided with five female parts distributed substantially evenly along the length of the side member of the window frame.

The female parts are preferably attached to the window in the state of delivery, but may also be attached to the window at the installation site.

Turning now to FIGS. 40-44 the windows generally designated 1 mounted at the end of a row of windows are provided with flashing members, cover members 900 and cover brackets 801 adapted for attachment thereof.

In the embodiment shown, the flashing used at the bottom is in one piece and will not be described in further detail, whereas two flashing members are used along the side of the window. This keeps the sizes of the flashing members relatively uniform and makes them relatively easy to handle, transport and store. Cover members between neighbouring windows are formed in a slightly different member than the cover member 900 at the end, but will not be described in further detail. Common to all cover members is that they provide for a weathertight transition between the pane and other parts of the windows.

Figure 41:
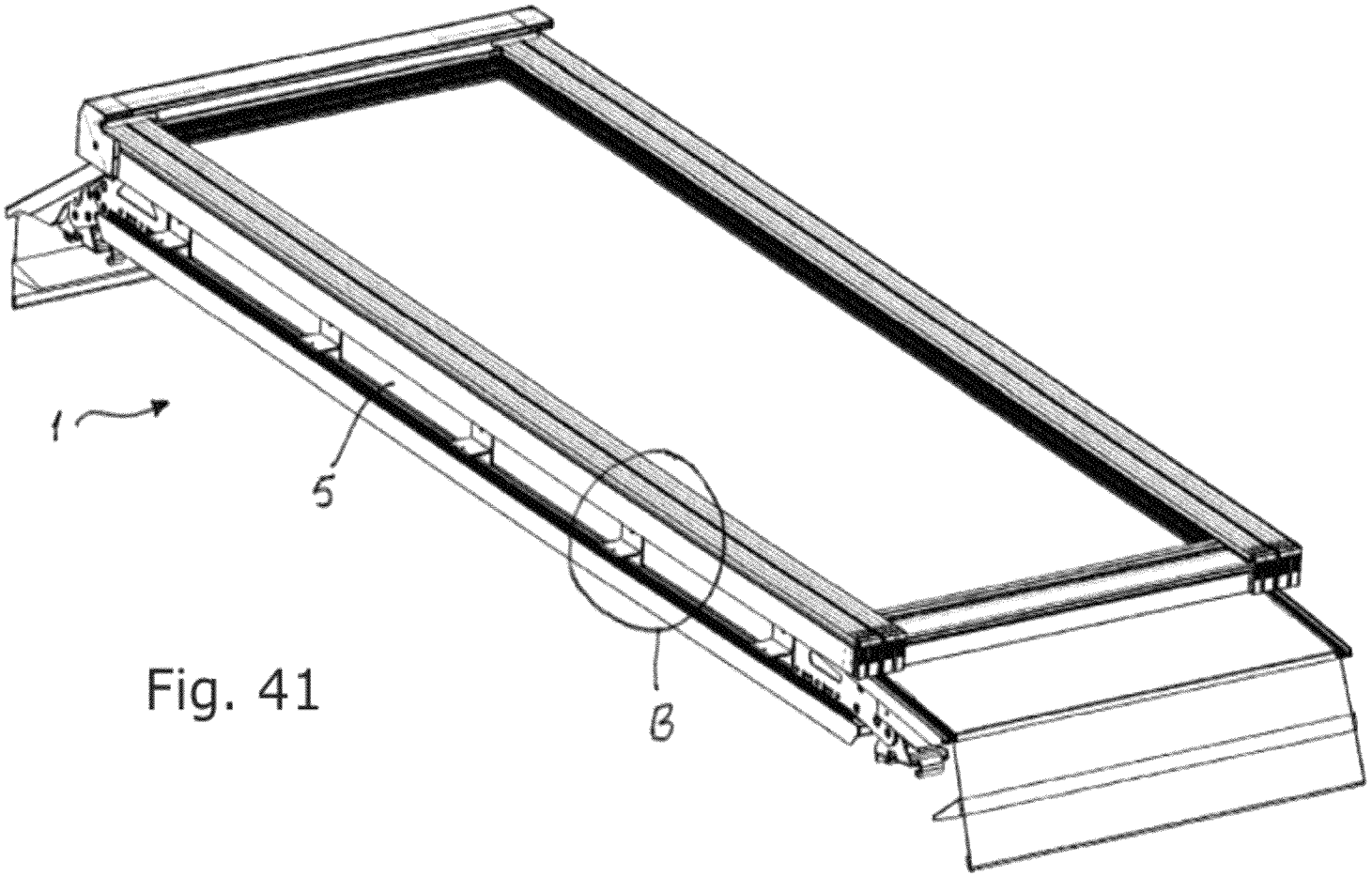
FIG. 41 is a view corresponding to FIG. 40, with some parts removed.
Figure 43:
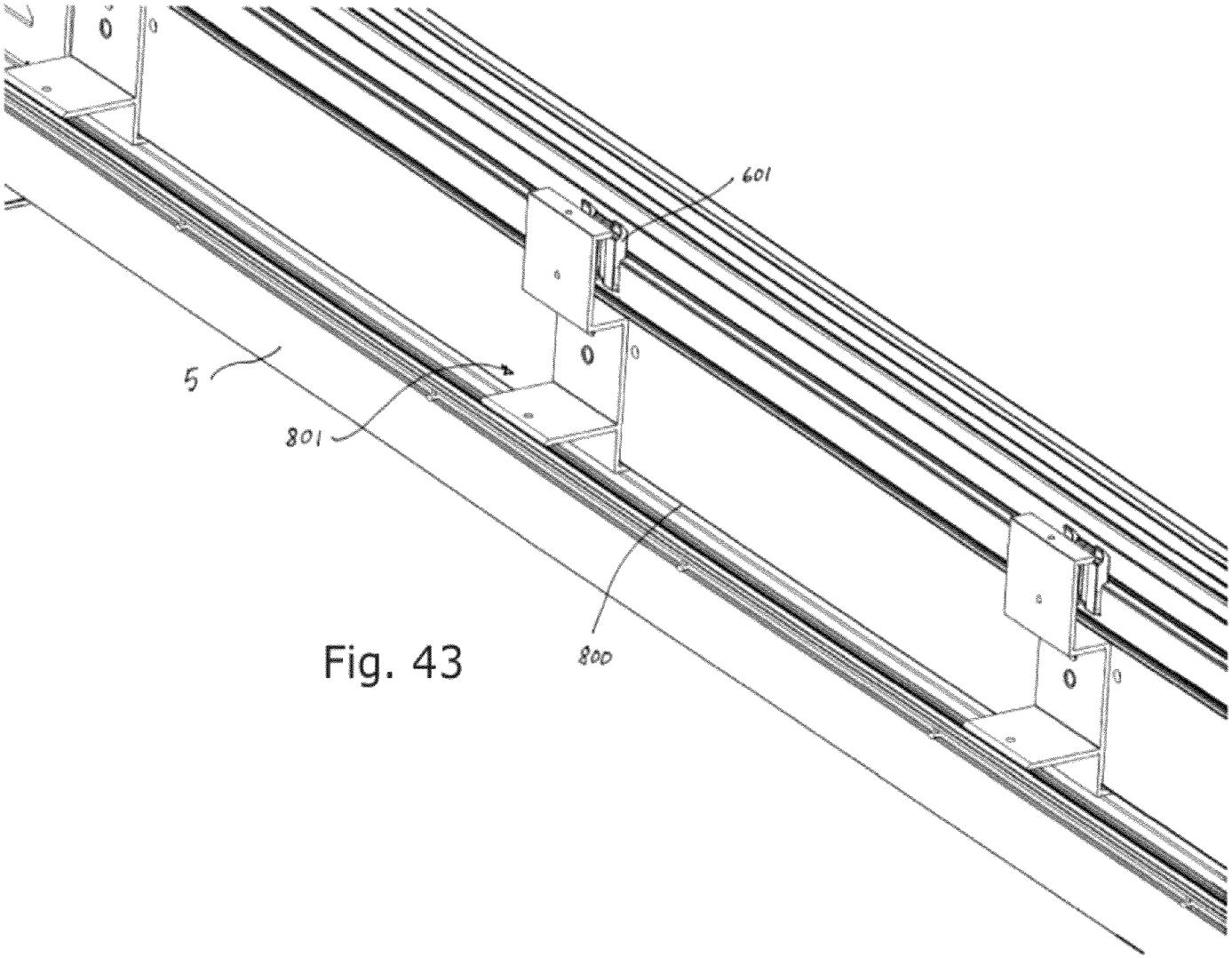
Figure 44:
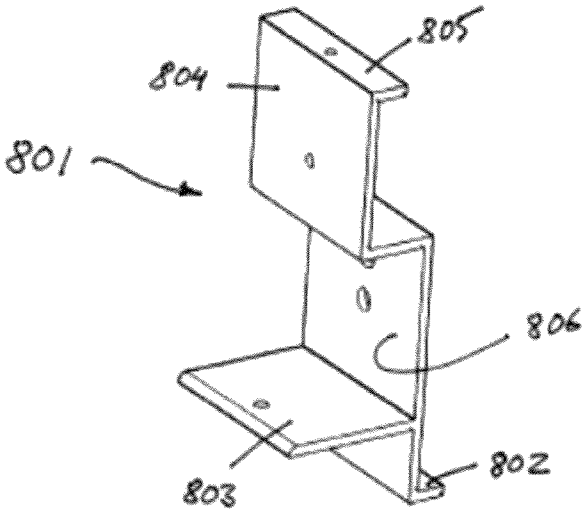

As may be seen in FIG. 43 showing detail B of FIG. 41, the cover brackets 801 are attached to the side member 5 of the frame of the window 1 on top of the pre-mounted female connection brackets 601, which are not to be used, since this side of the window is not to be interconnected with another window. The female connection brackets may advantageously contribute to the attachment of the cover brackets, though this is not the case with the embodiment shown.

The cover bracket 801 comprises a number of portions extending from a main portion 806. A lower flange 802 of the cover bracket 801 projects into a groove 800 in the frame side member 5 otherwise used for holding a sealing strip. This mode of attachment provides for a good resistance against rotation of the bracket, which is particularly important, when heavy winds affect the cover members. In addition, the need for screws penetrating the frame side member for attachment of the brackets is reduced, which is a particular advantage when using frame members made from fibre glass reinforced plastic.

It is preferred that all windows are made identical and that the sealing strip is then removed at the site of installation on those windows, which are to be used at the ends. It is, however, also possible to provide some windows without sealing strips or with interruptions of the sealing. Other alternatives includes to use cover brackets without the flange or to provide special windows with different side members than the standard window and/or pre-mounted cover brackets for use at the ends.

Figure 48:
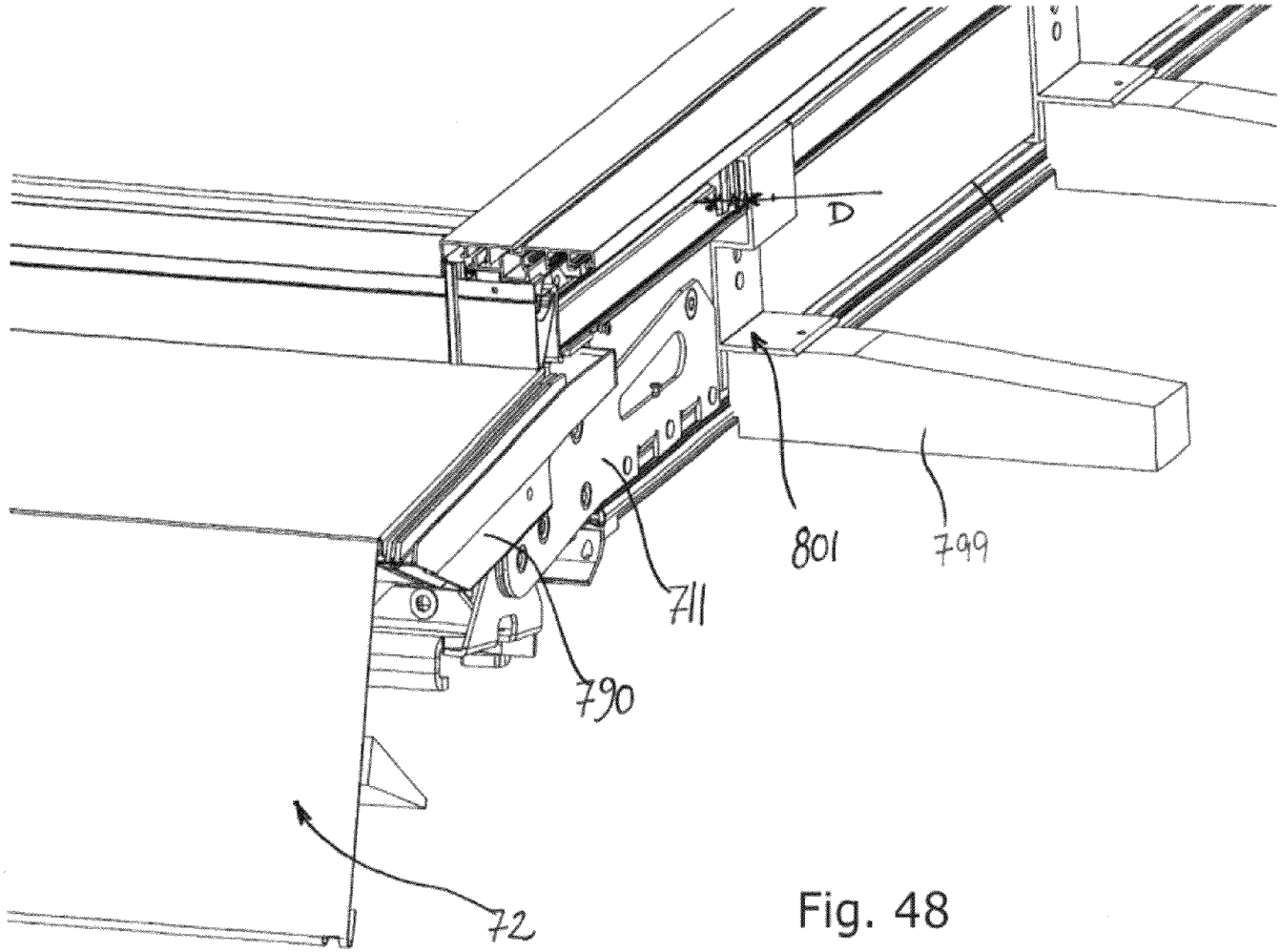
FIG. 48 is a perspective view of the detail of FIG. 47 in the mounted state.

A flange 803 projecting outwards perpendicularly to the side member 5 of the frame is intended for interconnection with battens 799 or insulating members used on top of the upstand (cf. FIG. 48).

Figure 42:
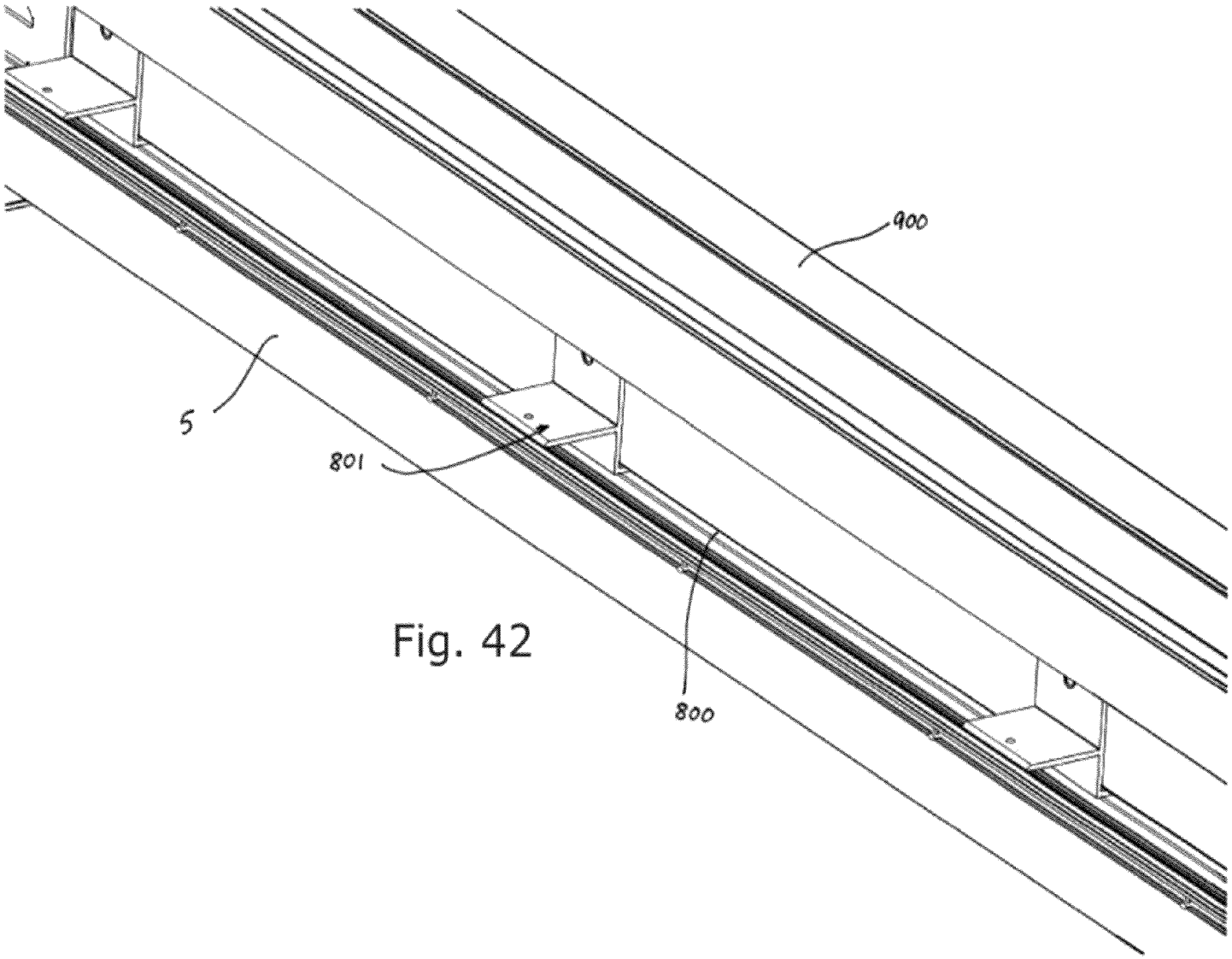
FIGS. 42 to 44 show partial perspective views, on a larger scale, of detail B of FIG. 41.

At the top the cover bracket 801 has an off-set section 804, which is used for attachment of the cover members, the cover members having a vertical section, which is later covered by the covering shown in FIG. 42. The section being off-set means that a gap is formed between the cover and the frame side member. This gap may be left open, filled with insulating material or used for technical installations such as wiring for solar cells or the like. Furthermore, a flange 805 serves as an abutment and fixing means for covering 900.

Figure 45:
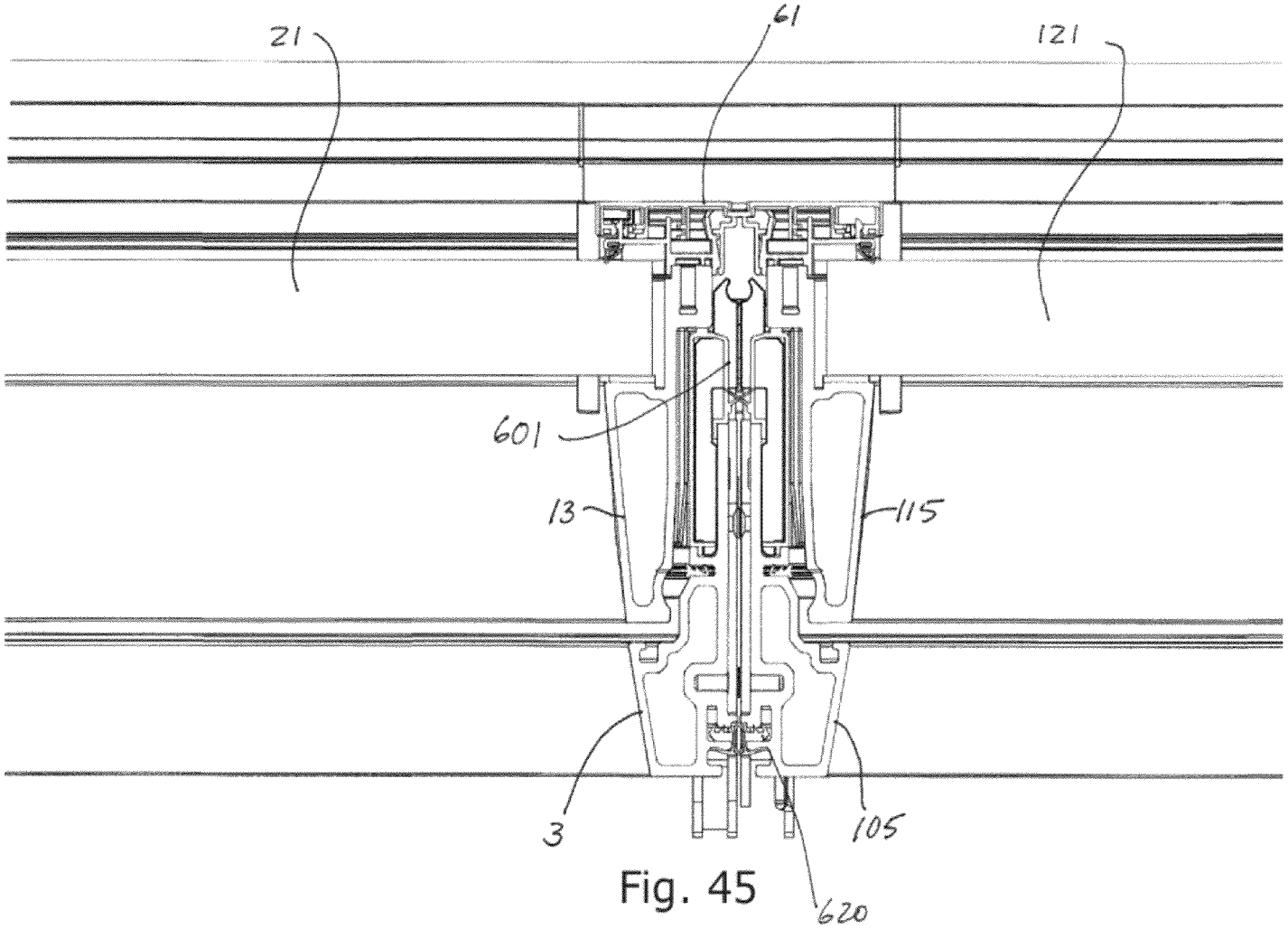
FIG. 45 is a view corresponding to FIG. 25, however of a another embodiment and showing the detail of FIGS. 35 to 38.

In the embodiment of FIG. 45, two windows according to the invention are built-in side-by-side. Thus the left-hand window may be as described in the above, thus showing the right-hand frame member 3, the right-hand sash member 13 and the pane element 21. To the right of the window, there is a further window, of which the left-hand frame member 105 and sash member 115 are shown. The sash member 115 carries the pane element 121 together with other sash members. The connection bracket 601 is shown as well. A common cover element 61 spans the gap between the adjacent sash members 13 and 115 and extends somewhat into the border portion of the respective pane element 21, 121. In the lower portion of the frame members 3, 105, a sealing 620 is mounted.

Figure 46:
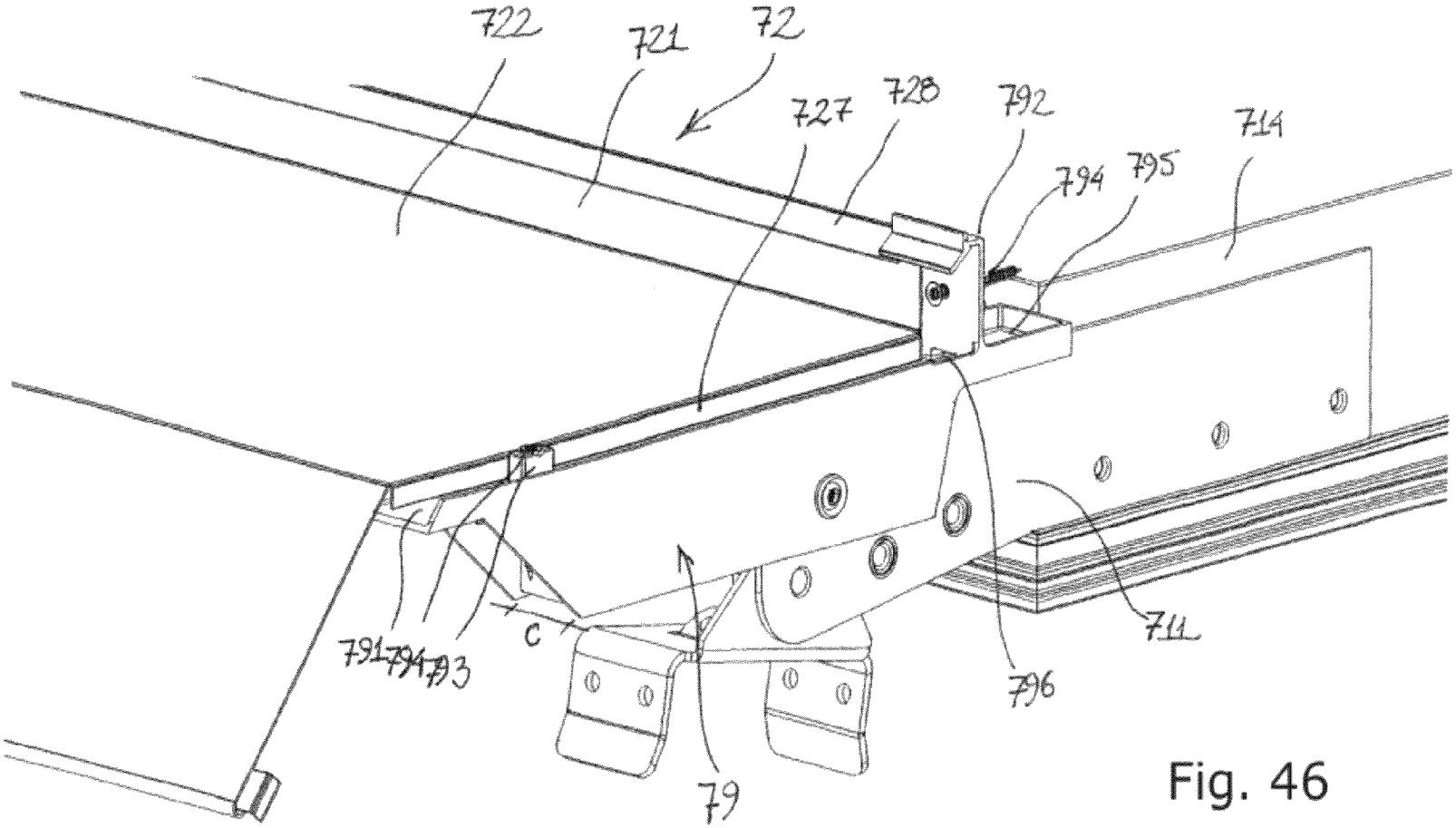
FIG. 46 is a perspective view of a detail of a further embodiment.
Figure 47:
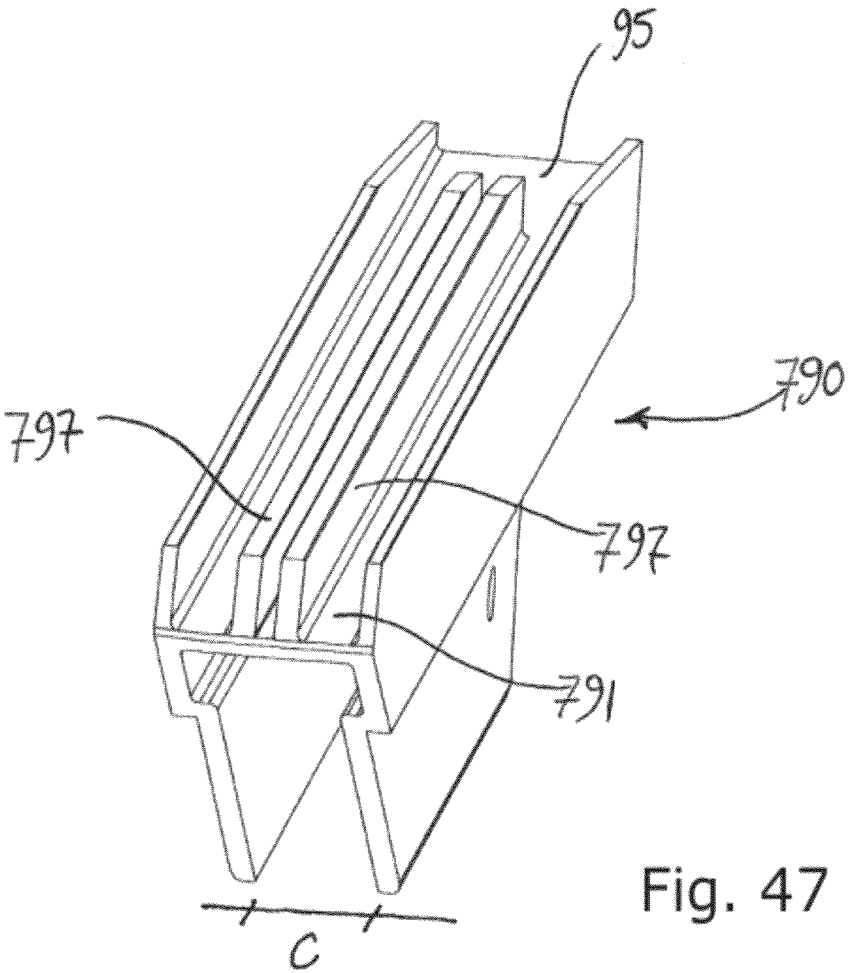
FIG. 47 is a perspective view of a detail of an alternative embodiment.

Turning now to FIGS. 46 to 48, a further detail of the connection between two neighboring windows is shown. Here, a bottom flashing member 72 is attached by means of a connector bracket 79 riding on mounting bracket 711. As may be seen, the connector bracket has a substantially H-shaped cross-sectional shape, with the two lower legs extending on each side of the mounting bracket and the two upper legs forming a gutter 791. It is, however, to be understood that a connector bracket does not need to ride on the mounting bracket but may also be attached directly to the window frame.

In this embodiment, the second leg 722 of the flashing member 72 has a bent end edge 727, which engages a longitudinal edge of the gutter 791 formed in the upper surface of the connector bracket 79. This engagement keeps the flashing member 72 from moving away from the connector bracket 79 in the horizontal direction and at the centre of the gutter is a raised part 793, which prevents it from moving in the opposite direction. The gutter is open-ended at the end of the connector bracket, which is furthest from the window, to allow it to be used for drainage purposes as will be explained below, but if this is not the case, the flashing member will also be kept from moving away from the window.

The first leg 721 of the flashing member 72 is located underneath a projection 792 on the connector bracket 79 having the shape of an inverted J, which projects upwards. The height of the body of the J corresponds substantially to the height of the first leg 721, so that the upper edge of the first leg lies at the inner corner of the J, where the arm and body meets, the first leg abutting the body of the J. In this case, the first leg 721 has a bent edge 728 as is common to this kind of flashing members and the arm of the J corresponds in size and shape to this bend edge. The projection 792 may be elastic so that is can be bend slightly to ease the introduction of the flashing member 72.

The engagement between the flashing member 72 and the projection 792 prevents the flashing member from moving in the vertical direction and combined with the engagement between the bent end edge 727 and the gutter 791 the flashing member is thus fixated.

An even further fixation is achieved when a covering member (not shown) having substantially the same cross-sectional shape as the bottom flashing member 72 is subsequently attached to cover the gutter. This may be done using screws 794 penetrating the projection 792 and the raised part 793.

The attachment of the flashing member 72 to the connector bracket 79 will, under normal circumstances, be sufficient, which means that the need for penetrating the window frame for the purpose of attaching the flashing member can eliminated entirely.

A further optimisation may be achieved by using the projection 792 to support covering and cladding members (not shown), including those used at the side of the window.

A connector bracket 790 without projection may, however, also be used, an example of which is shown in FIGS. 47 and 48, where like elements have been given the same reference numbers as in FIG. 46. This connector bracket is further provided with a pair of walls 797 extending in the length direction of the gutter 791 and dividing it in three. These walls are intended as an alternative to the raised part 793 and have the advantage that the screw will get a good hold even if displaced along the length of the gutter. They may also serve as guides or abutments for the flashing members.

FIGS. 47 and 48 shows only a single flashing member 72, but it is to be understood that a second flashing member, such as the bottom flashing member of a neighbouring window, could be placed with a bent end edge engaging the opposite longitudinal edge of the gutter 791.

Likewise, even though the use of the connector brackets 79, 790 is described primarily with reference to the securing of bottom flashing members, it to be understood that similar principles apply to the securing and interconnection of top flashing members.

To ensure that two flashing members engaging the same connector bracket 79, 790 are aligned, the gutter is of a rectangular shape, when seen from above. This also contributes to a narrow joint, which is advantageous both with regards to tightness and aesthetics. If, however, an angle is desired between neighbouring flashing members, this may be achieved by providing the longitudinal gutter edges at an angle to each other.

As explained above the connector brackets 79, 790 in FIGS. 46-48 rest on the mounting bracket 711 used for interconnecting the window to the roof structure. The mounting bracket shown is substantially flush with the external side of the side member of the window frame, which means that when mounting two windows side by side their mounting brackets will lie closely along each other. To allow the connector bracket 79, 790 to span both mounting brackets and thus come to lie at the centre of the joint between them, the space C between its two walls should be somewhat larger than twice the thickness of the body of the mounting bracket.

This centred position of the connector bracket 79, 790 entails that the joint between neighbouring flashing members will also be centred which will lead to an aesthetical advantage, but it is of course also possible to provide a connector bracket at each mounting bracket. In that case a separate member will be needed for covering the space or joint between the two connector members of neighbouring windows, but this may be done by means of an extra-wide version of the covering member used for covering the gutter as described above.

Alternatively, the flashing members may be provided with flanges on their inner side adapted for engagement with the gutter and have end sections projecting over the flanges to reach the neighbouring flashing member and possibly overlap it.

As is well known to the skilled person, windows are often provided with a drainage channel (not shown) at the side members of the window frame for the purpose of collecting condensation as well as any water that might penetrate the system of cladding and covering members. The centred position of the connector bracket 79, 790 allows it to be used for draining water collected by such drainage channels and possibly even for receiving water from covering members.

When the connector bracket 79, 790 has a hollow design as shown in FIGS. 46 to 48, it may be filled wholly or partially with an insulating material to minimize the risk of the connector bracket forming an undesirable thermal bridge. In the state of delivery the connector bracket may be filled substantially entirely with insulating material, which can then be removed wholly or partially to make room for mounting brackets or other means of attachment.

The invention should not be regarded as being limited to the embodiments shown in the drawings and described in the above. Various modifications and combinations may be carried out within the scope of the appended claims.

The invention claimed is:

1. A method of installing a window arrangement comprising a number of neighbouring windows, said windows including side frame members, comprising the steps of a) providing a support structure including an upstand, b) providing a first gable element of a set of gable elements, c) mounting the first gable element on the support structure, d) providing a second gable element of said set, e) connecting the second gable element temporarily and releasably to the support structure at a distance from the first gable element corresponding substantially to the width of a window, f) providing a first window of a first set of opposed windows, the window comprising a plurality of predefined connection points, g) connecting the first window with the first and second gable elements and with the support structure, h) providing a second window of the first set of opposed windows, wherein the second window comprises a plurality of predefined connection points corresponding to the predefined connection points of said first window, i) connecting the second window with the first window and with the support structure, j) releasing the second gable element from the first window and from the support structure, k) connecting the second gable element temporarily and releasably to the support structure at a distance from the first set of opposed windows corresponding substantially to the width of a window, whereby steps f) to k) are repeated a number of times corresponding to a predefined number of sets of opposed windows, except for step k) wherein the second gable element is connected permanently to the windows of the last set, the method further comprising the step of:

l) connecting the windows of neighbouring sets of opposed windows to each other at said connection points, and m) connecting the windows of the first set of opposed windows to the first gable element at said connection points and connecting the windows of the last set of opposed windows to the second gable element at said connection points.

2. The method of claim 1, further comprising the steps of a) providing a first rafter element, b) mounting the first rafter element on the support structure, c) providing a second rafter element, d) connecting the second rafter element to the support structure at a distance from the first rafter element corresponding substantially to the width of a window, e) providing a first window of a first set of opposed windows, f) connecting the first window with the first and second rafter elements and with the support structure, g) providing a second window of the first set of opposed windows, h) connecting the second window with the first window in said connection points, with the first and second rafter elements, and with the support structure, i) connecting a third rafter element to the support structure at a distance from the first set of opposed windows, wherein steps e) to h) are repeated a number of times corresponding to a predefined number of sets of opposed windows, and k) connecting the windows of neighbouring sets of opposed windows to each other in said connection points.

3. The method of claim 1, further comprising the steps of:

a) providing a mounting beam device comprising a first and second beam and a joint member, b) connecting the mounting beam device temporarily and releasably to the support structure at a distance from the first gable element corresponding substantially to the width of a window, c) providing a first window of a first set of opposed windows, d) connecting the first window with the first gable element, with the mounting beam device and with the support structure, e) providing a second window of the first set of opposed windows, f) connecting the second window with the first window and with the support structure, g) releasing the mounting beam device from the first window and from the support structure, h) connecting the mounting beam device temporarily and releasably to the support structure at a distance from the first set of opposed windows corresponding substantially to the width of a window, whereby steps b) to g) are repeated a number of times corresponding to a predefined number of sets of opposed windows, and i) connecting the windows of neighbouring sets of opposed window to each other in said connection points.

4. The method of claim 1, comprising the further step of providing cover elements and flashing elements.

5. The method of claim 4, comprising the step of providing each side frame member not facing the side frame member of a neighbouring window with a plurality of cover brackets.

6. The method of claim 5, wherein said cover brackets are located at said predefined connection points.

* * * * *